US010339872B2

(12) United States Patent
Park

(10) Patent No.: US 10,339,872 B2
(45) Date of Patent: Jul. 2, 2019

(54) SOURCE DRIVER INTEGRATED CIRCUIT, CONTROLLER, ORGANIC LIGHT EMITTING DISPLAY PANEL, ORGANIC LIGHT EMITTING DISPLAY DEVICE, AND METHOD FOR DRIVING ORGANIC LIGHT EMITTING DISPLAY DEVICE

(71) Applicant: LG Display Co., Ltd., Seoul (KR)

(72) Inventor: YongKyu Park, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 82 days.

(21) Appl. No.: 15/196,344

(22) Filed: Jun. 29, 2016

(65) Prior Publication Data

US 2017/0004776 A1 Jan. 5, 2017

(30) Foreign Application Priority Data

Jun. 30, 2015 (KR) ..... 10-2015-0093828

(51) Int. Cl.
*G09G 3/3291* (2016.01)
*G09G 3/30* (2006.01)
(Continued)

(52) U.S. Cl.
CPC ..... *G09G 3/3275* (2013.01); *G09G 3/30* (2013.01); *G09G 3/3208* (2013.01);
(Continued)

(58) Field of Classification Search
CPC .. G09G 3/3233; G09G 3/3291; G09G 3/3275; G09G 3/3208; G09G 2320/045;
(Continued)

(56) References Cited

U.S. PATENT DOCUMENTS 7,924,256 B2 * 4/2011 Jeon ..... G09G 3/3611 345/100
8,274,503 B2 * 9/2012 Kwon ..... G09G 3/3233 345/214
(Continued)

FOREIGN PATENT DOCUMENTS

CN 103165079 A 6/2013
CN 103714777 A 4/2014
(Continued)

OTHER PUBLICATIONS

Office Action dated Jun. 4, 2018, from the Chinese Patent Office issued in related Chinese Patent Application No. 201610499252.2.

*Primary Examiner* — Dismery Mercedes
(74) *Attorney, Agent, or Firm* — Morgan, Lewis & Bockius LLP

(57) ABSTRACT

There are provided a source driver integrated circuit, a controller, an organic light emitting display panel, an organic light emitting display device, and a method for driving the organic light emitting display device. Thus, it is possible to provide a structure in which different sensing components configured to sense sub-pixel characteristics can sense characteristics of the same sub-pixel together, and the structure enables more accurate recognition of a sensing difference between the sensing components on the basis of sensing values obtained from the respective sensing components and the sensing difference to be corrected using the recognized sensing difference. Thus, an image quality can be improved.

14 Claims, 21 Drawing Sheets

(51) Int. Cl.
*G09G 3/32* (2016.01)
*G09G 3/3275* (2016.01)
*G09G 3/3208* (2016.01)
*G09G 3/3233* (2016.01)

(52) U.S. Cl.
CPC ... *G09G 3/3233* (2013.01); *G09G 2300/0426* (2013.01); *G09G 2300/0452* (2013.01); *G09G 2300/0819* (2013.01); *G09G 2300/0842* (2013.01); *G09G 2310/0264* (2013.01); *G09G 2310/0286* (2013.01); *G09G 2310/0297* (2013.01); *G09G 2320/0233* (2013.01); *G09G 2320/0295* (2013.01); *G09G 2320/045* (2013.01)

(58) Field of Classification Search
CPC ... G09G 2320/0295; G09G 2310/0294; G09G 3/325; G09G 3/3266; G09G 3/3688; G09G 2320/043; G09G 2310/0291; G09G 2310/027; G09G 2310/0286; G06F 3/044; G06F 3/0418; G06F 3/0416; G06F 3/041; G06F 3/0412
See application file for complete search history.

(56) References Cited

U.S. PATENT DOCUMENTS 9,076,387 B1* 7/2015 Lee ..... G09G 3/20
9,082,364 B2* 7/2015 Lin ..... G09G 3/3688
9,202,404 B2* 12/2015 Kimura ..... G09G 3/20
9,236,011 B2* 1/2016 Mizukoshi ..... G09G 3/3291
9,329,739 B2* 5/2016 Jang ..... G06F 3/044
9,349,311 B2* 5/2016 Yu ..... G09G 3/006
9,449,560 B2* 9/2016 Oh ..... G09G 3/325
9,537,501 B2* 1/2017 Lee ..... H03M 1/1295
9,557,616 B2* 1/2017 Chung ..... G02F 1/13452
9,601,043 B2* 3/2017 Hikichi ..... G09G 3/20
9,818,341 B2* 11/2017 Kwon ..... G09G 3/3233
2007/0139311 A1* 6/2007 Cho ..... G09G 3/3241 345/76
2009/0244047 A1* 10/2009 Mizutani ..... G09G 3/325 345/211
2010/0026639 A1* 2/2010 Lee ..... G06F 3/0412 345/173
2010/0149391 A1* 6/2010 Kameshima ..... H04N 5/32 348/300
2010/0194697 A1* 8/2010 Hotelling ..... G06F 3/0412 345/173
2011/0001492 A1* 1/2011 Nys ..... H03M 1/123 324/658
2011/0080437 A1 4/2011 Yamashita et al.
2011/0194003 A1* 8/2011 Saito ..... H04N 5/378 348/294
2012/0081338 A1* 4/2012 Kim ..... G09G 3/3614 345/204
2013/0147694 A1 6/2013 Kim et al.
2013/0162617 A1* 6/2013 Yoon ..... G09G 3/3291 345/211
2013/0257831 A1 10/2013 Kim et al.
2014/0022289 A1* 1/2014 Lee ..... G09G 3/3283 345/691
2014/0092076 A1* 4/2014 Lee ..... G09G 3/3291 345/212
2014/0111466 A1 4/2014 Kim et al.
2014/0152602 A1* 6/2014 Miyamoto ..... G06F 3/0416 345/173
2014/0176622 A1* 6/2014 Jung ..... G09G 3/3208 345/690
2014/0368415 A1* 12/2014 Kim ..... G09G 3/3233 345/77
2015/0091888 A1* 4/2015 Min ..... G09G 3/3291 345/212
2015/0162925 A1* 6/2015 Lee ..... H03M 1/1295 250/208.1
2015/0170565 A1 6/2015 Hong et al.
2015/0356897 A1* 12/2015 Shin ..... G09G 3/3233 345/211
2016/0055791 A1* 2/2016 Kishi ..... G09G 3/3241 345/212
2016/0140898 A1* 5/2016 Hyun ..... G09G 3/3233 345/694
2016/0225302 A1* 8/2016 Shin ..... G09G 3/3225

FOREIGN PATENT DOCUMENTS

CN 103777801 A 5/2014
CN 103903582 A 7/2014
CN 104715717 A 6/2015

* cited by examiner

SOURCE DRIVER INTEGRATED CIRCUIT, CONTROLLER, ORGANIC LIGHT EMITTING DISPLAY PANEL, ORGANIC LIGHT EMITTING DISPLAY DEVICE, AND METHOD FOR DRIVING ORGANIC LIGHT EMITTING DISPLAY DEVICE

CROSS-REFERENCE TO RELATED APPLICATIONS

This application claims priority from Korean Patent Application No. 10-2015-0093828, filed on Jun. 30, 2015, which is hereby incorporated by reference for all purposes as if fully set forth herein.

BACKGROUND OF THE INVENTION

Field of the Invention

The present invention relates to a source driver integrated circuit, a controller, an organic light emitting display panel, an organic light emitting display device, and a method for driving the organic light emitting display device.

Description of the Related Art

An organic light emitting display device which has recently attracted attention as a display device uses a self-emitting organic light emitting diode (OLED) and thus has the advantages of a high response speed and increased light emitting efficiency, brightness and viewing angle.

Each sub-pixel disposed in the organic light emitting display device may include an OLED and a driving transistor configured to drive the OLED.

Meanwhile, the driving transistor within each sub-pixel has intrinsic characteristics such as a threshold voltage, and mobility. Further, each driving transistor is degraded according to a driving time, and, thus, the intrinsic characteristics may be changed.

Furthermore, the OLED in each sub-pixel is also degraded according to a driving time, and, thus, intrinsic characteristics may be changed.

Therefore, a difference in driving time between sub-pixels causes a difference in degradation between driving transistors and/or between OLEDs and may also cause a difference in characteristic between driving transistors and/or between OLEDs.

A difference in sub-pixel characteristic including a difference in characteristic between driving transistors and a difference in characteristic between OLEDs may become a main factor that causes a brightness difference between sub-pixels, resulting in deterioration of an image quality.

Accordingly, various techniques for compensating a difference in sub-pixel characteristic have been developed.

Such techniques for compensating a difference in sub-pixel characteristic need to accurately sense sub-pixel characteristics.

However, if there is a sensing difference between sensing components configured to sense sub-pixel characteristics, accurate sensing data cannot be obtained and a sub-pixel characteristic compensation may be performed on the basis of inaccurate sensing data.

Further, if there is a sensing difference between sensing components and a sub-pixel characteristic compensation is inaccurately performed, a phenomenon (image variation), in which a dim block is seen in a certain direction on a screen, may occur, so that an image quality may deteriorate.

SUMMARY

Accordingly, the present invention is directed to a source driver integrated circuit, a controller, an organic light emitting display panel, an organic light emitting display device, and a method for driving organic light emitting display device that substantially obviate one or more of the problems due to limitations and disadvantages of the related art.

An object of the present invention is to enable improvement in image quality by reducing or removing a sensing difference between sensing components configured to sense sub-pixel characteristics.

An another object of the present invention is also to enable more accurate recognition of a sensing difference between sensing components configured to sense sub-pixel characteristics.

Another object of the present invention is to provide a source driver integrated circuit that enables improvement in image quality by reducing or removing a sensing difference between sensing units configured to sense sub-pixel characteristics, a controller, an organic light emitting display panel, an organic light emitting display device, and a method for driving the organic light emitting display device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic light emitting display device comprises a first source driver integrated circuit electrically connected to Q (Q≥1) number of first sensing lines; a second source driver integrated circuit electrically connected to S (S≥1) number of second sensing lines; and at least one difference sensing line configured to electrically connect at least one of the S number of second sensing lines and the first source driver integrated circuit.

In another aspect, an organic light emitting display panel comprises a plurality of sub-pixels; a plurality of data lines configured to supply a data voltage; a plurality of sensing lines electrically connected to a corresponding sub-pixel; and at least one difference sensing line of which one end is connected to a first driver connection area and the other end is connected to one of S (S≥1) number of sensing lines corresponding to a second driver connection area.

In another aspect, a source driver integrated circuit comprises D number of output buffers corresponding to D (D≥1) number of data channels; D number of digital-analog converters corresponding to the D number of data channels; and an analog-digital converter electrically connected to S number of sensing lines through S (S≥1) number of sensing channels and electrically connected to at least one difference sensing line through at least one difference sensing channel.

In another aspect, an organic light emitting display device comprises a first analog-digital converter electrically connected to Q (Q≥1) number of first sensing lines; a second analog-digital converter electrically connected to S number of second sensing lines; and at least one difference sensing line configured to electrically connect at least one of the S (S≥1) number of second sensing lines and the first analog-digital converter.

In another aspect, a method for driving an organic light emitting display device comprises sensing an analog voltage value of a second sensing line electrically connected to a second analog-digital converter within a second source driver integrated circuit and converting the analog voltage value into a second sensing value, which is a digital value, by the second analog-digital converter; sensing the analog voltage value of the second sensing line electrically connected to a difference sensing line electrically connected to a first analog-digital converter within a first source driver integrated circuit and converting the analog voltage value into a first neighbor sensing value, which is a digital value, by the first analog-digital converter through the difference sensing line; and correcting an analog-digital conversion difference between the first analog-digital converter and the second analog-digital converter by comparing the first neighbor sensing value and the second sensing value.

In another aspect, a controller comprises a first sensing data receiving unit configured to receive first sensing data including a first neighbor sensing value generated by a first analog-digital converter; a second sensing data receiving unit configured to receive second sensing data including a second sensing value generated by a second analog-digital converter; and an analog-digital conversion difference correction unit configured to correct first sensing value and second sensing value to be received on the basis of the first neighbor sensing value and the second sensing value.

The first neighbor sensing value received by the first sensing data receiving unit and the second sensing value received by the second sensing data receiving unit are sensing values of characteristics of the same sub-pixel.

Embodiments of the present invention described herein enables improvement in image quality by reducing or removing a sensing difference between sensing components configured to sense sub-pixel characteristics.

Further, embodiments of the present invention enables more accurate recognition of a sensing difference between sensing components configured to sense sub-pixel characteristics.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENT

Figure 1:
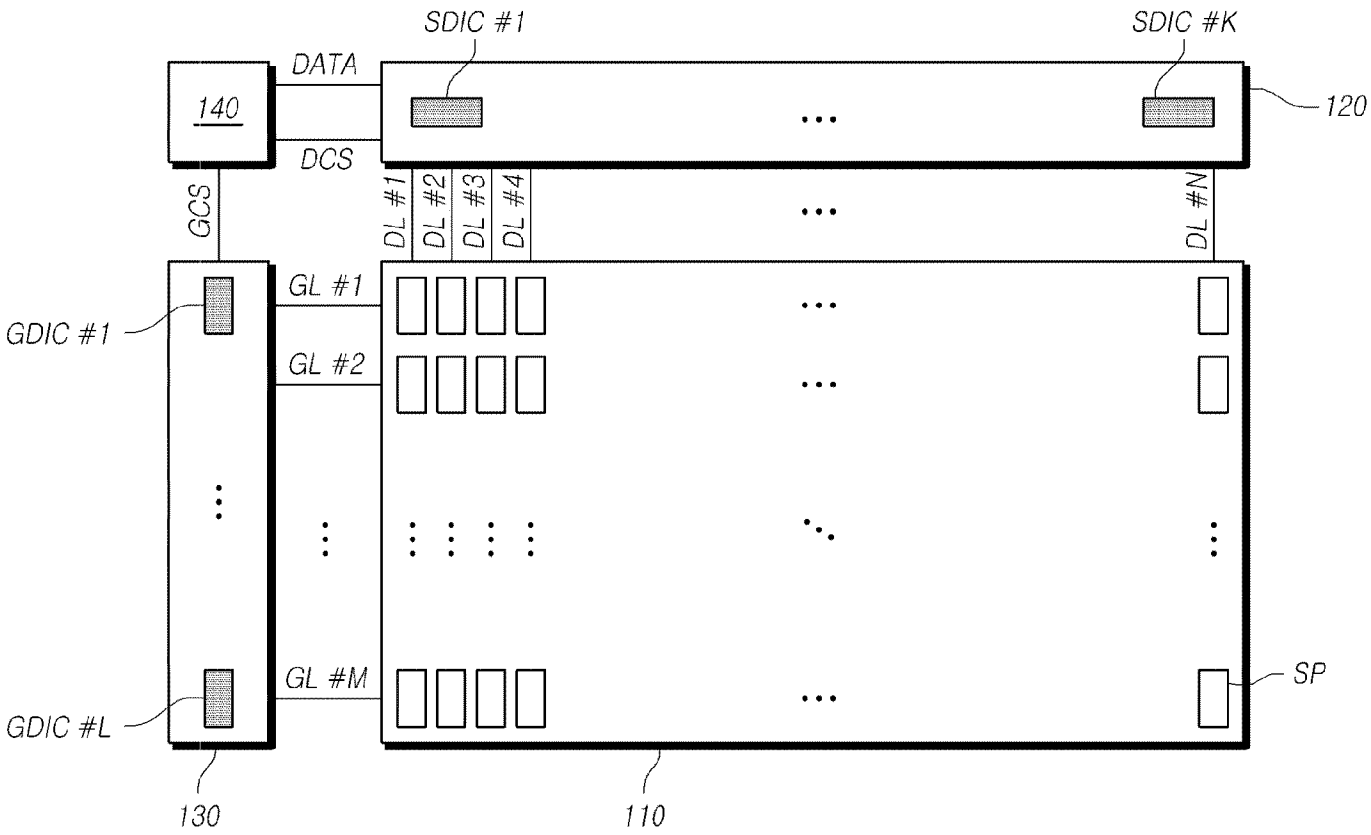
FIG. 1 is a schematic system configuration view of an organic light emitting display device according to the present exemplary embodiments.

Hereinafter, some exemplary embodiments of the present invention will be described in detail with reference to the accompanying drawings. In adding reference numerals to components throughout the drawings, like reference numerals may designate like components even though components are shown in different drawings. Further, in explaining the exemplary embodiments of the present invention, a detailed explanation of well-known components or functions may be omitted to avoid unnecessarily obscuring the subject matter of the present invention.

Further, in describing components of the present disclosure, terms such as first, second, A, B, (a), and (b) can be used. These terms are used only to differentiate the components from other components. Therefore, the nature, order, sequence, or number of the corresponding components is not limited by these terms. It is to be understood that when one element is referred to as being "connected to" or "coupled to" another element, it may be directly connected to or directly coupled to another element, connected to or coupled to another element, having still another element "intervening" therebetween, or "connected to" or "coupled to" another element via still another element.

FIG. 1 is a schematic system configuration view of an organic light emitting display device 100 according to the present exemplary embodiments.

Referring to FIG. 1, the organic light emitting display device 100 according to the present exemplary embodiments includes an organic light emitting display panel 110 in which a plurality of data lines DL #1 to DL #N and a plurality of gate lines GL #1 to GL #M are disposed and a plurality of sub-pixels SP is disposed, a data driver 120 configured to drive the plurality of data lines DL #1 to DL #N, a gate driver 130 configured to drive the plurality of gate lines GL #1 to GL #M, and a controller 140 configured to control the data driver 120 and the gate driver 130.

Furthermore, the controller 140 controls the data driver 120 and the gate driver 130 by supplying various control signals to the data driver 120 and the gate driver 130.

The controller 140 starts a scan according to timing implemented in each frame, converts input image data input from the outside to be suitable for a data signal form used by the data driver 120, outputs the converted image data DATA, and controls a driving of data at a proper time corresponding to the scan.

The controller 140 may be a timing controller used in a general display technology or a controller including the timing controller and performing additional control functions.

The data driver 120 drives the plurality of data lines DL #1 to DL #N by supplying a data voltage to the plurality of data lines DL #1 to DL #N. Herein, the data driver 120 may also be referred to as "source driver".

The gate driver 130 sequentially drives the plurality of gate lines GL #1 to GL #M by sequentially supplying a scan signal to the plurality of gate lines GL #1 to GL #M. Herein, the gate driver 130 may also be referred to as "scan driver".

The gate driver 130 sequentially supplies an ON voltage or OFF voltage scan signal to the plurality of gate lines GL #1 to GL #M according to the control of the controller 140.

If a specific gate line is opened by the gate driver 130, the data driver 120 converts the image data DATA received from the controller 140 into a data voltage Vdata of an analog form and supplies the data voltage Vdata to the plurality of data lines DL #1 to DL #N.

The data driver 120 is located at only one side (for example, upper side or lower side) of the organic light emitting display panel 110 in FIG. 1, but may be located at both sides (for example, upper side and lower side) of the organic light emitting display panel 110 according to the driving method or the design of the panel.

The gate driver 130 is located at only one side (for example, left side or right side) of the organic light emitting display panel 110 in FIG. 1, but may be located at both sides (for example, left side and right side) of the organic light emitting display panel 110 according to the driving method or the design of the panel.

The controller 140 receives input image data together with various timing signals, such as a vertical synchronization signal Vsync, a horizontal synchronization signal Hsync, an input data enable (DE) signal, and a clock signal CLK from the outside (for example, a host system).

The controller 140 converts the input image data input from the outside in correspondence to a data signal form used by the data driver 120 and outputs the converted image data DATA. Further, in order to control the data driver 120 and the gate driver 130, the controller 140 receives timing signals, such as a vertical synchronization signal Vsync, a horizontal synchronization signal Hsync, an input DE signal, and a clock signal CLK, generates various control signals DCS and GCS, and outputs the control signals DCS and GCS to the data driver 120 and the gate driver 130.

For example, the controller 140 outputs various gate control signals GCS including a gate start pulse GSP, a gate shift clock GSC, a gate output enable (GOE) signal, and the like, in order to control the gate driver 130.

Herein, the gate start pulse GSP controls an operation start timing of one or more gate driver integrated circuits constituting the gate driver 130. The gate shift clock GSC is a clock signal commonly input to the one or more gate driver integrated circuits, and controls a shift timing of a scan signal (gate pulse). The gate output enable (GOE) signal designates timing information of the one or more gate driver integrated circuits.

Further, the controller 140 outputs various data control signals DCS including a source start pulse SSP, a source sampling clock SSC, a source output enable (SOE) signal, and the like, in order to control the data driver 120.

Herein, the source start pulse SSP controls a data sampling start timing of one or more source driver integrated circuits constituting the data driver 120. The source sampling clock SSC is a clock signal for controlling a data sampling timing in each source driver integrated circuit. The source output enable (SOE) signal controls an output timing of the data driver 120.

Meanwhile, the data driver 120 may include two or more source driver integrated circuits SDIC #1 to SDIC #K (K is a natural number of 2 or more).

Each of the two or more source driver integrated circuits SDIC #1 to SDIC #K may include a shift register, a latch circuit, a digital-analog converter DAC, an output buffer, and the like.

The gate driver 130 may include one or more gate driver integrated circuits GDIC #1 to GDIC #L (L is a natural number of 1 or more).

Each of the one or more gate driver integrated circuits GDIC #1 to GDIC #L may include a shift register, a level shifter, and the like.

Meanwhile, each sub-pixel SP disposed in the organic light emitting display panel 110 is electrically connected to a data line and one or more gate lines and may be connected to one or more other signal lines.

Each sub-pixel SP disposed in the organic light emitting display panel 110 may be configured to include various circuit elements such as an organic light emitting diode OLED, a transistor, and a capacitor in order to drive the sub-pixel.

The kinds and number of circuit elements constituting each sub-pixel SP may be determined in various ways depending on a function and a design of the organic light emitting display device 100.

Figure 2:
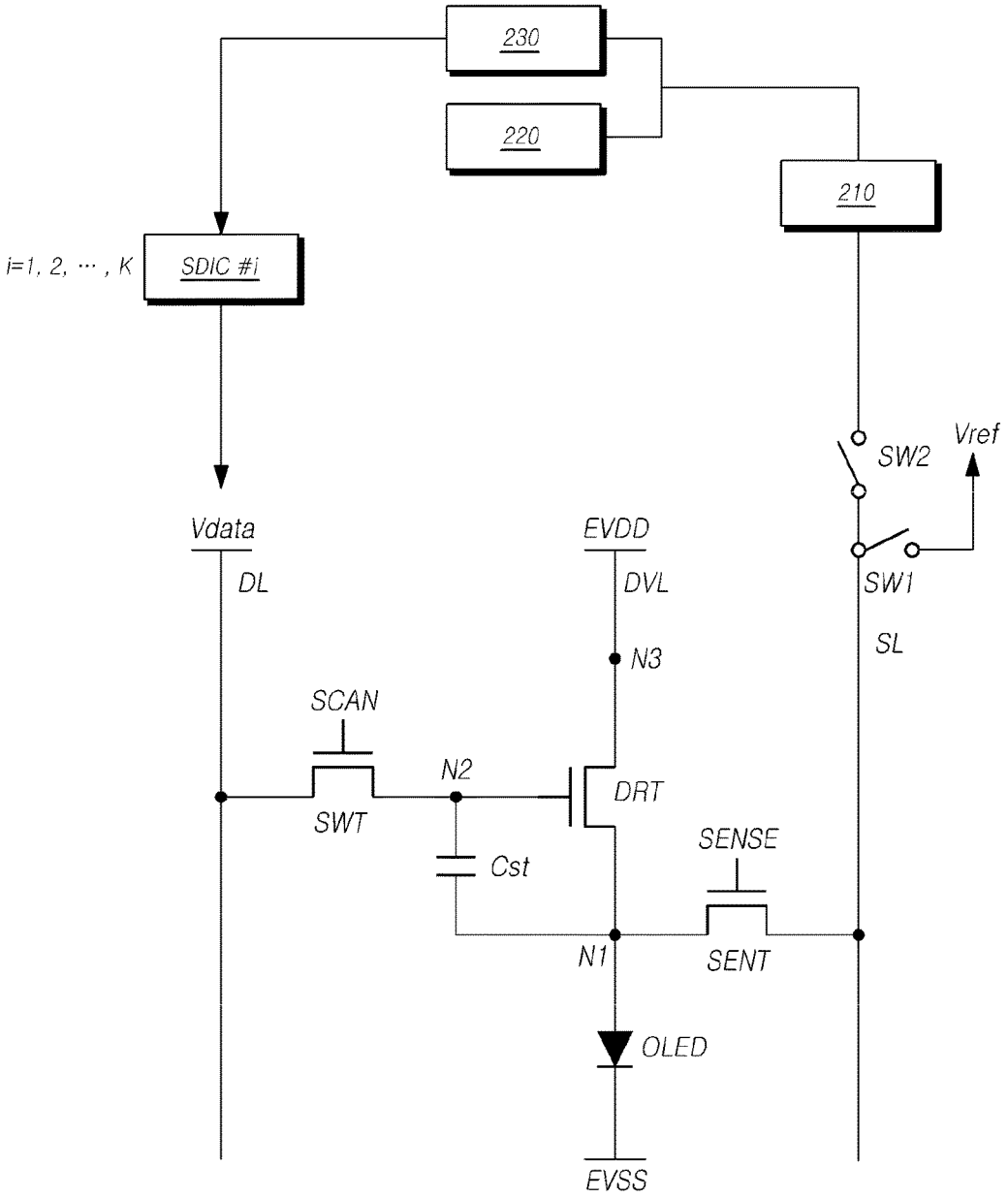
FIG. 2 is a diagram illustrating a sub-pixel structure and a compensation circuit of the organic light emitting display device according to the present exemplary embodiments.

FIG. 2 is a diagram illustrating a sub-pixel structure and a compensation circuit of the organic light emitting display device 100 according to the present exemplary embodiments.

Referring to FIG. 2, each sub-pixel in the organic light emitting display device 100 according to the present exemplary embodiments basically includes an organic light emitting diode OLED, a driving transistor DRT configured to drive the organic light emitting diode OLED, a switching transistor SWT configured to transfer a data voltage to a first node N1 of the driving transistor DRT, and a storage capacitor Cst configured to maintain a data voltage, which is an image signal voltage, or a voltage corresponding thereto for one frame time.

The organic light emitting diode OLED may include a first electrode (for example, anode electrode), an organic layer, and a second electrode (for example, cathode electrode).

The driving transistor DRT drives the organic light emitting diode OLED by supplying a driving current to the organic light emitting diode OLED.

The first node N1 of the driving transistor DRT may be connected to the first electrode of the organic light emitting diode OLED, and may be a source node or a drain node.

A second node N2 of the driving transistor DRT may be connected to a source node or a drain node of the switching transistor SWT, and may be a gate node.

A third node N3 of the driving transistor DRT may be connected to a driving voltage line DVL for supplying a driving voltage EVDD, and may be a drain node or a source node.

The driving transistor DRT and the switching transistor SWT may be of n type as illustrated in FIG. 2 or may be of p type.

The switching transistor SWT is connected between a data line DL and the second node N2 of the driving transistor DRT, and may be controlled by receiving a scan signal SCAN through the gate line by the gate node.

The switching transistor SWT is turned on by the scan signal SCAN and transfers a data voltage Vdata supplied from the data line DL to the second node N2 of the driving transistor DRT.

Meanwhile, in the organic light emitting display device 100 according to the present exemplary embodiments, as a driving time of each sub-pixel SP is increased, the circuit elements such as the organic light emitting diode OLED and the driving transistor DRT may be degraded. Therefore, intrinsic characteristics (for example, a threshold voltage, a mobility, and the like.) of the circuit elements such as the organic light emitting diode OLED and the driving transistor DRT may be changed.

The degree of change in characteristics may be different between circuit elements due to a difference in the degree of degradation between the circuit elements.

A change and difference in characteristics between the circuit elements may be referred to as a change and difference in sub-pixel characteristic. The change and difference in sub-pixel characteristic may cause inaccuracy in brightness of a sub-pixel and a difference in brightness between sub-pixels SP. Thus, an image quality of the organic light emitting display panel 110 may deteriorate.

Herein, the sub-pixel characteristics may include, for example, a threshold voltage of the organic light emitting diode OLED, a threshold voltage and a mobility of the driving transistor DRT, or the like.

Accordingly, the organic light emitting display device 100 according to the present exemplary embodiments may provide a sub-pixel sensing function for sensing a change and difference in sub-pixel characteristic and a sub-pixel compensation function for compensating a change and difference in sub-pixel characteristic using a sensing result.

In this case, a sub-pixel structure may be modified and a sensing component and a compensation component may be further provided.

Accordingly, each sub-pixel disposed in the organic light emitting display panel 110 according to the present exemplary embodiments may further include a sensing transistor SENT in addition to the organic light emitting diode OLED, the driving transistor DRT, the switching transistor SWT, and the storage capacitor Cst illustrated in FIG. 2.

Referring to FIG. 2, the sensing transistor SENT is connected between the first node N1 of the driving transistor DRT and a sensing line SL that supplies a reference voltage Vref and may be controlled by receiving a sensing signal SENSE, which is one kind of scan signals, through a gate node.

Herein, the sensing line SL is electrically connected to the sensing transistor SENT and may have the same potential as a voltage of the first node N1 of the driving transistor DRT. Therefore, the sensing line SL may function as a path for sensing sub-pixel characteristics.

The sensing line SL is also referred to as a reference voltage line since it is electrically connected to a sub-pixel and supplies the reference voltage Vref to the first node N1 of the driving transistor DRT within the sub-pixel.

The sensing transistor SENT is turned on by the sensing signal SENSE and applies the reference voltage Vref supplied through the sensing line SL to the first node N1 of the driving transistor DRT.

Further, the sensing transistor SENT may also function as a sensing path for sensing a voltage of the first node N1 of the driving transistor DRT.

Meanwhile, the scan signal SCAN and the sensing signal SENSE may be respectively applied to the gate node of the switching transistor SWT and the gate node of the sensing transistor SENT through different gate lines. In this case, two gate lines may be connected to each sub-pixel.

In some cases, the scan signal SCAN and the sensing signal SENSE may be the same signal and respectively applied to the gate node of the switching transistor SWT and the gate node of the sensing transistor SENT through the same gate line. In this case, one gate line may be connected to each sub-pixel.

Referring to FIG. 2, the organic light emitting display device 100 according to the present exemplary embodiments may include a sensing unit 210 configured to sense a change and difference in sub-pixel characteristic, a memory 220 configured to store a sensing result from the sensing unit 210, and a compensation unit 230 configured to compensate a change and difference in sub-pixel characteristic.

The organic light emitting display device 100 according to the present exemplary embodiments may further include a first switch SW1 and a second switch SW2 in order to control a sensing operation, i.e., in order to control a voltage-applied state of the first node N1 of the driving transistor DRT within the sub-pixel SP to be in a state required for sensing of sub-pixel characteristics.

The first switch SW1 may control whether or not to supply the reference voltage Vref to the sensing line SL.

If the first switch SW1 is turned on to supply the reference voltage Vref to the sensing line SL, the reference voltage Vref is applied to the first node N1 of the driving transistor DRT through the sensing transistor SENT which is turned on.

Meanwhile, if a voltage of the first node N1 of the driving transistor DRT is in a state suitable for reflecting sub-pixel characteristics, i.e., if a voltage of the sensing line SL is in a state suitable for reflecting sub-pixel characteristics, the second switch SW2 is turned on, and, thus, the sensing unit 210 is connected to the sensing line SL.

Accordingly, the sensing unit 210 senses the voltage of the sensing line SL, i.e., the voltage of the first node N1 of the driving transistor DRT, in a state suitable for reflecting sub-pixel characteristics.

For example, one sensing line SL may be disposed on every sub-pixel column or may be disposed on every two or more sub-pixel columns.

For example, if one pixel includes four sub-pixels (a red sub-pixel, a white sub-pixel, a green sub-pixel, and a blue sub-pixel), one sensing line SL may be disposed on every pixel column.

A voltage sensed by the sensing unit 210 may be a voltage value for sensing a threshold voltage Vth of the driving transistor DRT or a voltage value for sensing a mobility of the driving transistor DRT.

For example, if a sub-pixel is driven to sense the threshold voltage of the driving transistor DRT, when a threshold voltage sensing operation is performed, the first node N1 and the second node N2 of the driving transistor DRT are initialized to a data voltage Vdata for threshold voltage sensing operation and the reference voltage Vref, respectively. Then, the first node N1 of the driving transistor DRT is floated and thus a voltage of the first node N1 of the driving transistor DRT is increased. After the elapse of a predetermined period of time, the voltage of the first node N1 of the driving transistor DRT is saturated.

The saturated voltage of the first node N1 of the driving transistor DRT corresponds to a difference between the data voltage Vdata and the threshold voltage Vth.

Therefore, the voltage sensed by the sensing unit 210 corresponds to a voltage obtained by subtracting the threshold voltage Vth of the driving transistor DRT from the data voltage Vdata.

If the sub-pixel is driven to sense a mobility of the driving transistor DRT, when a mobility sensing operation is performed, the first node N1 and the second node N2 of the driving transistor DRT are initialized to a data voltage Vdata for mobility sensing operation and the reference voltage Vref, respectively. Then, both the first node N1 and the second node N2 of the driving transistor DRT are floated and thus voltages of the first node N1 and the second node N2 are increased.

Herein, a voltage increasing speed (variation of voltage increase over time) represents a current performance, i.e., mobility, of the driving transistor DRT. Therefore, in the driving transistor DRT having a higher current performance (mobility), a voltage of the first node N1 of the driving transistor DRT is increased more steeply.

After the elapse of a predetermined period of time, the sensing unit 210 senses a voltage of the sensing line SL increased along with a voltage increase in the first node N1 of the driving transistor DRT.

The sensing unit 210 converts the voltage sensed for sensing a threshold voltage or a mobility into an analog value to generate sensing data and stores the sensing data in the memory 220.

The compensation unit 230 may perform a characteristic compensation process by figuring out characteristics (for example, threshold voltage, mobility) of the driving transistor DRT within the corresponding sub-pixel on the basis of the sensing data stored in the memory 220.

Herein, the characteristic compensation process may include a threshold voltage compensation process for compensating a threshold voltage of the driving transistor DRT and a mobility compensation process for compensating a mobility of the driving transistor DRT.

The threshold voltage compensation process may include: calculating a compensation value for compensating a threshold voltage; and storing the calculated compensation value in the memory 220 or modifying the corresponding image data DATA with the calculated compensation value.

The mobility compensation process may include: calculating a compensation value for compensating a mobility; and storing the calculated compensation value in the memory 220 or modifying the corresponding image data DATA with the calculated compensation value.

The compensation unit 230 may modify the image data DATA through the threshold voltage compensation process or the mobility compensation process and then supply the modified data to a source driver integrated circuit SDIC #i (i=1, 2, . . . , K) within the data driver 120.

Therefore, the source driver integrated circuit SDIC #i within the data driver 120 converts data (data modified for compensating sub-pixel characteristics) received from the controller 140 into a data voltage and supplies the data voltage to the corresponding sub-pixel, so that a characteristic compensation (threshold voltage compensation, mobility compensation) is actually applied.

The characteristics of the driving transistor can be compensated by the compensation unit 230, and, thus, a brightness difference between sub-pixels can be reduced or suppressed.

Meanwhile, each sensing unit 210 may be included in the corresponding source driver integrated circuit SDIC #i (i=1, 2, . . . , K).

Further, each sensing unit 210 may be implemented with an analog-digital converter ADC.

In the following, it is assumed that the sensing unit 210 is implemented with the analog-digital converter ADC and one sensing unit 210 included in each source driver integrated circuit SDIC #i.

The memory 220 may be located inside the controller 140 or on a control printed circuit board 160. Further, the compensation unit 230 may be located inside or outside the controller 140.

Meanwhile, in the organic light emitting display panel 110, the plurality of data lines DL #1 to DL #N for supplying a data voltage to the corresponding sub-pixel and the plurality of gate lines GL #1 to GL #M for supplying a scan signal to the corresponding sub-pixel are disposed, and a plurality of sensing lines electrically connected to the corresponding sub-pixel may be further disposed.

Further, in the organic light emitting display panel 110, at least one difference sensing line (DSL #1 in FIG. 12) of which one end is connected to a first driver connection area (1210 in FIG. 12) and the other end is connected to one of S (S≥1) number of sensing lines SL #j1, . . . , SL #jS corresponding to a second driver connection area (1220 in FIG. 12) may be further disposed.

Hereinafter, the layout of the sensing lines, the difference sensing line, and the like will be described in more detail.

Figure 3:
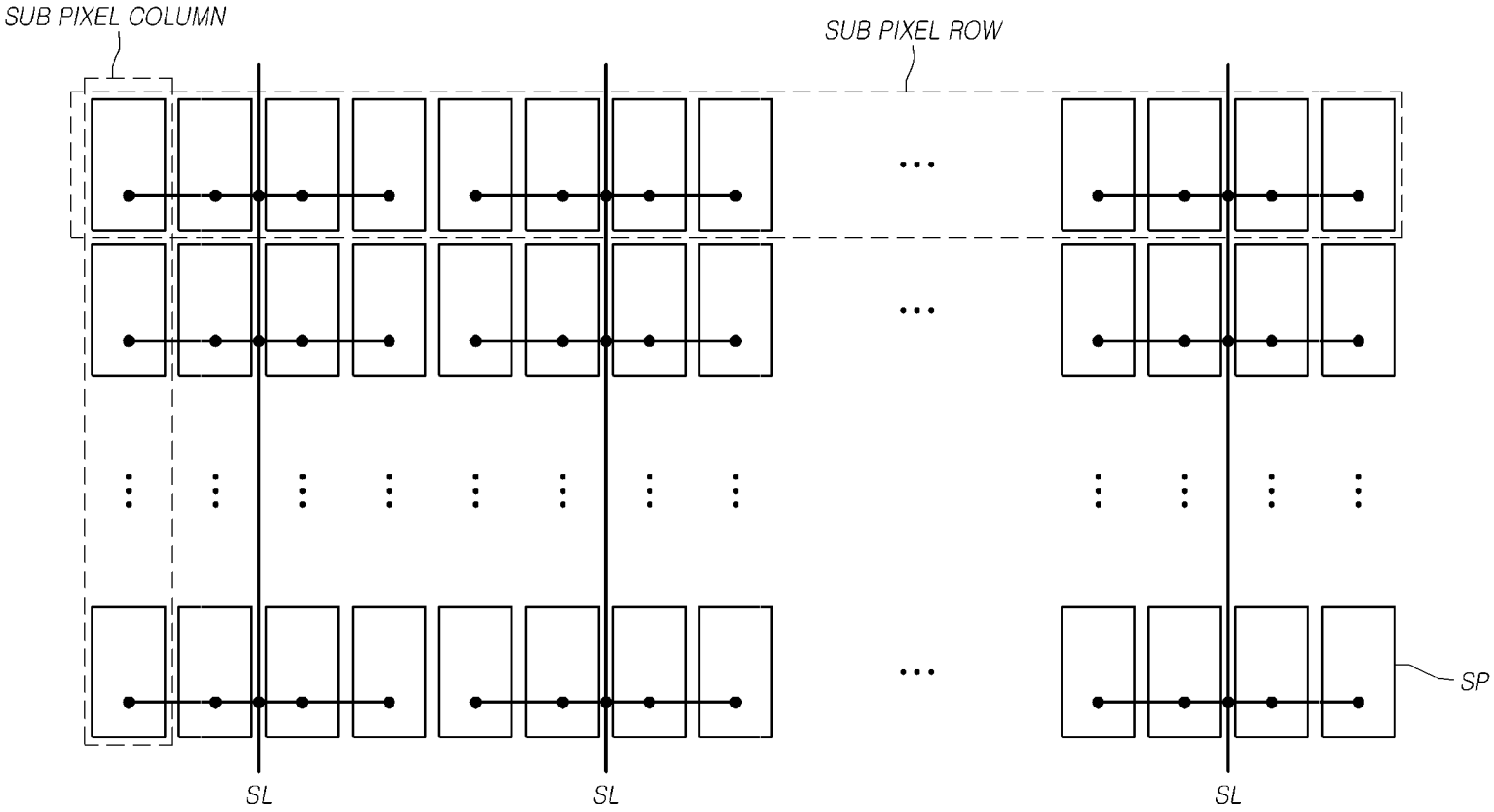
FIG. 3 is an exemplary diagram of a sensing line layout in an organic light emitting display panel according to the present exemplary embodiments.

FIG. 3 is an exemplary diagram of a sensing line layout in the organic light emitting display panel 110 according to the present exemplary embodiments.

For example, one sensing line SL may be disposed on every sub-pixel column or may be disposed on every two or more sub-pixel columns.

For example, if one pixel includes four sub-pixels (a red sub-pixel, a white sub-pixel, a green sub-pixel, and a blue sub-pixel), one sensing line SL may be disposed on every pixel column.

The number of sub-pixels, among sub-pixels included in a sub-pixel row, of which sub-pixel characteristics can be sensed together during a specific sensing timing period is determined by an interval between two sensing lines SL respectively disposed on sub-pixel columns.

For example, if one sensing line SL is disposed on every sub-pixel column, sub-pixel characteristics of sub-pixels included in the corresponding sub-pixel row can be sensed together during one sensing timing period.

That is, one sensing line SL is used to sense sub-pixel characteristics of one sub-pixel.

As another example, if one sensing line SL is disposed on every two sub-pixel columns, sub-pixel characteristics of half of sub-pixels included in the corresponding sub-pixel row can be sensed together during one sensing timing period.

That is, one sensing line SL is shared to sense sub-pixel characteristics of two sub-pixels.

As yet another example, if one sensing line SL is disposed on every three sub-pixel columns, sub-pixel characteristics of ⅓ of sub-pixels included in the corresponding sub-pixel row can be sensed together during one sensing timing period.

That is, one sensing line SL is shared to sense sub-pixel characteristics of three sub-pixels.

As still another example, if one sensing line SL is disposed on every four sub-pixel columns, sub-pixel characteristics of ¼ of sub-pixels included in the corresponding sub-pixel row can be sensed together during one sensing timing period.

That is, one sensing line SL is shared to sense sub-pixel characteristics of four sub-pixels.

A feature of the sensing line layout may be defined as a sensing line share ratio R. Herein, the sensing line share ratio R shows the number of sub-pixels which share one sensing line SL and of which sub-pixel characteristics are sensed together.

If one sensing line SL is disposed on every one sub-pixel column, the sensing line share ratio R is 1/1. If one sensing line SL is disposed on every two sub-pixel columns, the sensing line share ratio R is 1/2. If one sensing line SL is disposed on every three sub-pixel columns, the sensing line share ratio R is 1/3. If one sensing line SL is disposed on every four sub-pixel columns, the sensing line share ratio R is 1/4.

FIG. 3 illustrates a case where one sensing line SL is disposed on every four sub-pixel columns. Thus, in this case, the sensing line share ratio R is 1/4.

In the following, for convenience in explanation, the sensing line share ratio R is assumed as 1/4.

Figure 4:
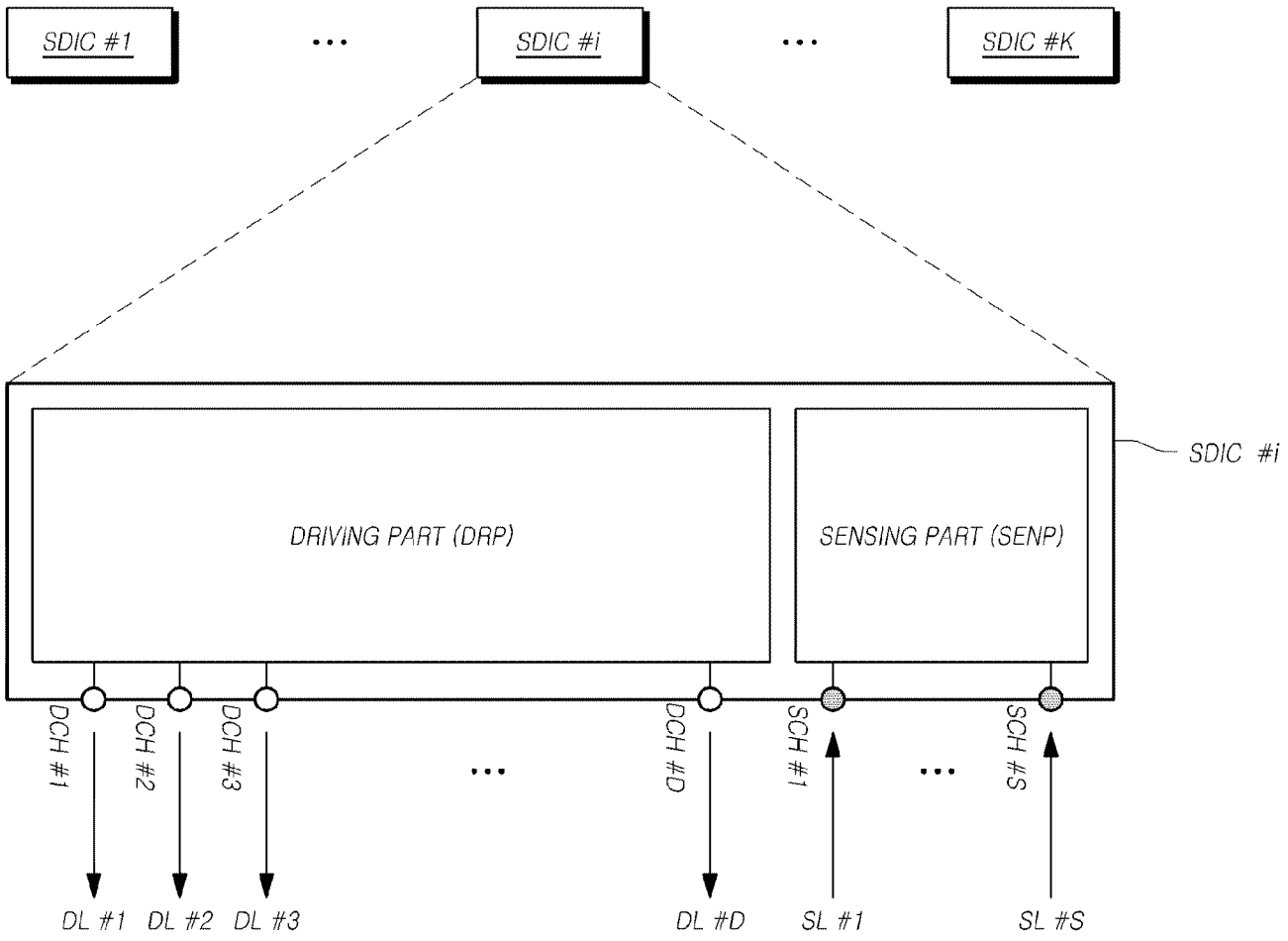
FIG. 4 is a schematic diagram of a source driver integrated circuit according to the present exemplary embodiments.

FIG. 4 is a schematic diagram of a source driver integrated circuit SDIC #i (i=1, 2, . . . , K) included in the organic light emitting display device 100 according to the present exemplary embodiments.

FIG. 4 schematically illustrates a structure of any source driver integrated circuit SDIC #i among K number of source driver integrated circuits SDIC #1, SDIC #2, . . . , SDIC #K (K is a natural number of 2 or more) included in the organic light emitting display device 100 according to the present exemplary embodiments.

Referring to FIG. 4, each source driver integrated circuit SDIC #i may include a driving part DRP for driving of data and a sensing part SENP involved in sensing of sub-pixel characteristics.

Referring to FIG. 4, the driving part DRP in each source driver integrated circuit SDIC #i outputs a data voltage to D (D is a natural number of 1 or more) number of data lines DL #1, . . . , DL #D through D number of data channels DCH #1, . . . , DCH #D.

Referring to FIG. 4, the sensing part SENP in each source driver integrated circuit SDIC #i senses a voltage of each of S (S is a natural number of 1 or more) number of sensing lines SL #1, . . . , SL #S through S number of sensing channels SCH #1, . . . , SCH #S.

In the present specification, a voltage of each of the S number of sensing lines SL #1, . . . , SL #S may correspond to a voltage of the first node N1 of the driving transistor DRT or the first electrode (for example, anode electrode or cathode electrode) of the organic light emitting diode OLED within the corresponding sub-pixel.

A voltage of each of the S number of sensing lines SL #1, . . . , SL #S may reflect characteristics (for example, a threshold voltage, a mobility, and the like.) of the driving transistor DRT within the corresponding sub-pixel or characteristics (for example, a threshold voltage, and the like.) of the organic light emitting diode OLED within the corresponding sub-pixel.

Figure 5:
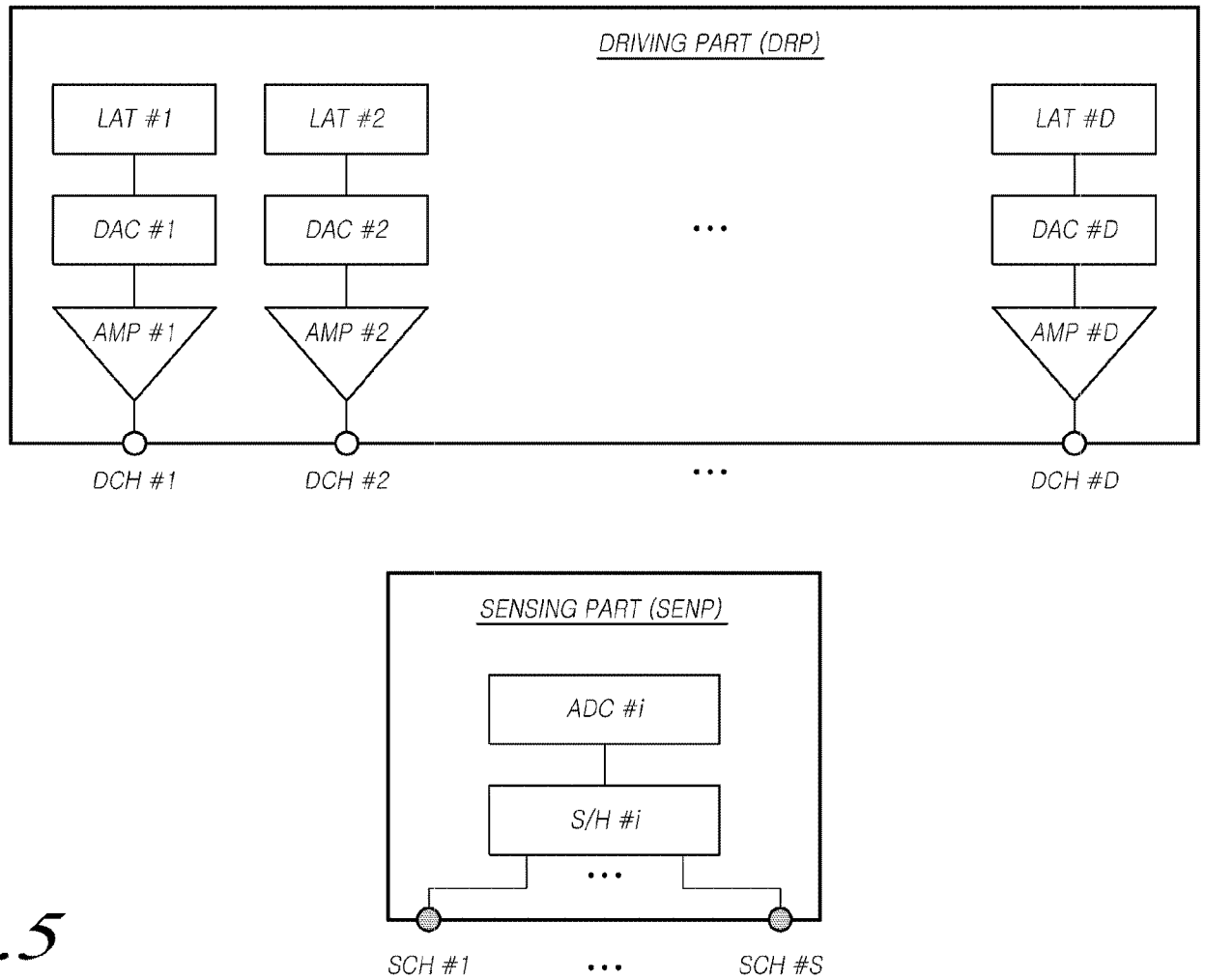
FIG. 5 is a diagram schematically illustrating a driving part and a sensing part within the source driver integrated circuit according to the present exemplary embodiments.

FIG. 5 is a diagram schematically illustrating a driving part DRP and a sensing part SENP within the source driver integrated circuit SDIC #i according to the present exemplary embodiments.

Referring to FIG. 5, in the driving part DRP in each source driver integrated circuit SDIC #i according to the present exemplary embodiments, D number of latch circuits LAT #1, . . . , LAT #D, D number of digital-analog converters DAC #1, . . . , DAC #D, and D number of output buffers AMP #1, . . . , AMP #D are included corresponding to the D number of data channels DCH #1, . . . , DCH #D.

Referring to FIG. 5, in the sensing part SENP in each source driver integrated circuit SDIC #i according to the present exemplary embodiments, a sample and hold circuit S/H #i configured to store and hold a voltage of each of the S number of sensing lines SL #1, . . . , SL #S through the S number of sensing channels SCH #1, . . . , SCH #S and an analog-digital converter ADC #i configured to convert the respective voltages of the S number of sensing lines SL #1, . . . , SL #S from the sample and hold circuit S/H #i into sensing values, which are digital values, in sequence are included.

Figure 6A:
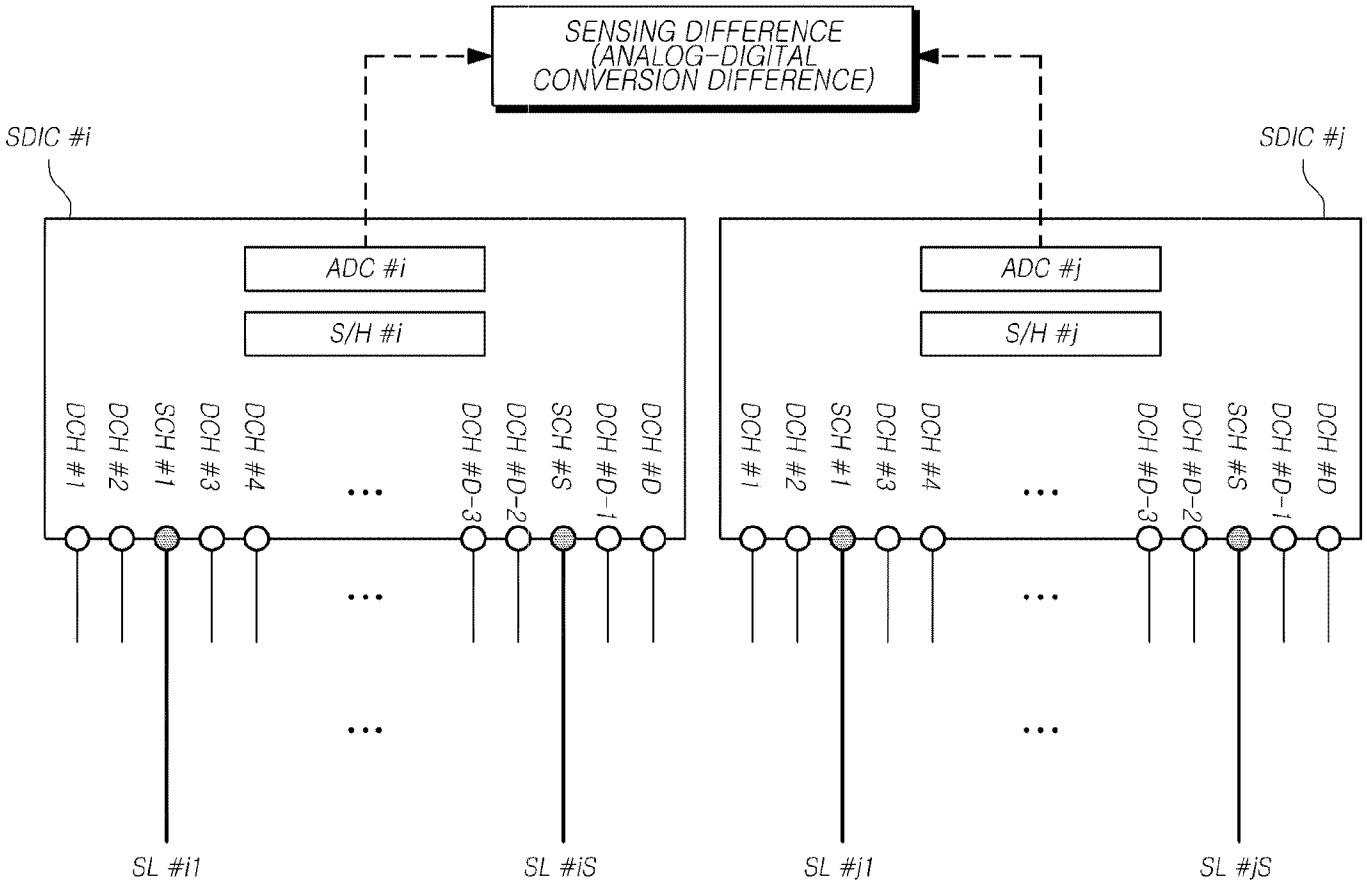
FIG. 6A and FIG. 6B are diagrams provided to explain a sensing difference (analog-digital conversion difference) between source driver integrated circuits according to the present exemplary embodiments.
Figure 6B:
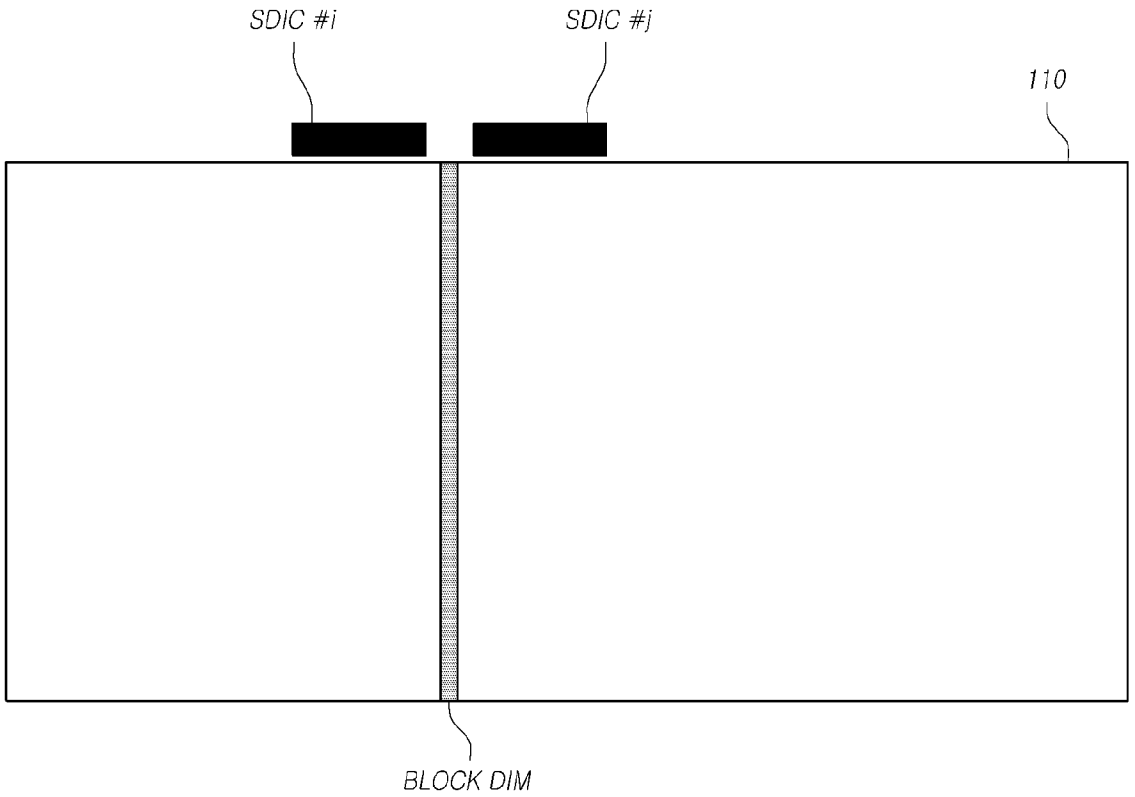

FIG. 6A and FIG. 6B are diagrams provided to explain a sensing difference (analog-digital conversion difference) between two source driver integrated circuits SDIC #i and SDIC #j (i=1, 2, . . . , K, j=1, 2, . . . , K) according to the present exemplary embodiments.

In the following, a first source driver integrated circuit SDIC #i and a second source driver integrated circuit SDIC #j will be exemplified as the two source driver integrated circuits SDIC #i and SDIC #j.

The first source driver integrated circuit SDIC #i and the second source driver integrated circuit SDIC #j may be source driver integrated circuits located right next to each other.

In some cases, the first source driver integrated circuit SDIC #i and the second source driver integrated circuit SDIC #j may not be located right next to each other, but may be spaced away from each other with one or more source driver integrated circuits interposed therebetween.

Referring to FIG. 6A, the first source driver integrated circuit SDIC #i is electrically connected to S number of first sensing lines SL #i1, . . . , SL #iS through the S (S≥1) number of sensing channels SCH #1, . . . , SCH #S.

The first source driver integrated circuit SDIC #i includes a first sample and hold circuit S/H #i and a first analog-digital converter ADC #i.

Referring to FIG. 6A, the second source driver integrated circuit SDIC #j is electrically connected to S number of second sensing lines SL #j1, . . . , SL #jS through the S (S≥1) number of sensing channels SCH #1, . . . , SCH #S.

Referring to FIG. 6A, the second source driver integrated circuit SDIC #j includes a second sample and hold circuit S/H #j and a second analog-digital converter ADC #j.

The first source driver integrated circuit SDIC #i and the second source driver integrated circuit SDIC #j may be connected to a different number of sensing lines through a different number of sensing channels, or may be connected to the same number of sensing lines through the same number of sensing channels.

For example, if the first source driver integrated circuit SDIC #i is connected to Q (Q≥1) number of first sensing lines through Q number of sensing channels and the second source driver integrated circuit SDIC #j is connected to S number of second sensing lines through S (S≥1) number of sensing channels, S and Q may be values identical to or different from each other.

In the present exemplary embodiments, it will be described that the first source driver integrated circuit SDIC #i is connected to S number of first sensing liens through S number of sensing channels and the second source driver integrated circuit SDIC #j is connected to S number of second sensing lines through S number of sensing channels, for convenience in explanation. That is, it will be described that the first source driver integrated circuit SDIC #i and the second source driver integrated circuit SDIC #j are connected to the same number of sensing lines through the same number of sensing channels.

Referring to FIG. 6A, the organic light emitting display device 100 according to the present exemplary embodiments can reduce a difference in characteristic between sub-pixels by sensing each of sub-pixel characteristics using the above-described sub-pixel characteristics sensing and compensation functions.

To this end, accuracy in analog-digital conversion by each of the first analog-digital converter ADC #i included in the first source driver integrated circuit SDIC #i and the second analog-digital converter ADC #j included in the second source driver integrated circuit SDIC #j needs to be guaranteed basically.

If the two analog-digital converters ADC #i and ADC #j included in the two source driver integrated circuits SDIC #i and SDIC #j respectively convert the same analog voltage value into different digital values (sensing values), i.e., if there is an analog-digital conversion difference (sensing difference), sensing accuracy is decreased. Therefore, sub-pixel characteristics may not be properly compensated.

That is, if there is difference between "a first neighbor sensing value" obtained by converting analog voltage values of S number of first sensing lines SL #i1, . . . , SL #iS (S is a natural number of 1 or more) into digital values by the first analog-digital converter ADC #i included in the first source driver integrated circuit SDIC #i and a second sensing value obtained by converting analog voltage values of S number of second sensing lines SL #j1, . . . , SL #jS (S is a natural number of 1 or more) into digital values by the second analog-digital converter ADC #j included in the second source driver integrated circuit SDIC #j, there is an analog-digital conversion difference (sensing difference). The sensing data obtained by each of the first source driver integrated circuit SDIC #i and the second source driver integrated circuit SDIC #j are inaccurate. Thus, a difference in sub-pixel characteristic cannot be accurately compensated.

A sensing difference between the two source driver integrated circuits SDIC #i and SDIC #j (i.e., an analog-digital conversion difference between the two analog-digital converter ADC #i and ADC #j) may be generated by environmental factors such as ambient temperatures and pressures of the two source driver integrated circuits SDIC #i and SDIC #j.

As described above, if there is a sensing difference between the two source driver integrated circuits SDIC #i and SDIC #j (i.e., an analog-digital conversion difference between the two analog-digital converter ADC #i and ADC #j), an image variation may be caused by the two source driver integrated circuits SDIC #i and SDIC #j as illustrated in FIG. 6B.

That is, referring to FIG. 6B, there may be non-uniformity in image quality on a border between screen areas respectively driven by the two source driver integrated circuits SDIC #i and SDIC #j having a sensing difference. Such a phenomenon (image variation) is referred to as a block dim phenomenon.

Accordingly, the present exemplary embodiments provide the source driver integrated circuits SDIC #1, . . . , SDIC #K, the controller 140, the organic light emitting display panel 110, the organic light emitting display device 100, and a method for driving the organic light emitting display device 100. Thus, it is possible to provide a structure in which different sensing components (for example, different analog-digital converters) configured to sense sub-pixel characteristics can sense characteristics of the same sub-pixel together (for example, difference sensing line, difference sensing channel, and the like), and the structure enables more accurate recognition of a sensing difference between the sensing components on the basis of sensing values obtained from the respective sensing components and the sensing difference to be corrected using the recognized sensing difference. Thus, an image quality can be improved.

More specifically, the organic light emitting display device 100 according to the present exemplary embodiments can improve an image variation caused by a sensing difference between the two source driver integrated circuits SDIC #i and SDIC #j, i.e., an analog-digital conversion difference between the two analog-digital converter ADC #i and ADC #j.

The organic light emitting display device 100 according to the present exemplary embodiments can recognize a sensing difference between the two source driver integrated circuits SDIC #i and SDIC #j, i.e., an analog-digital conversion difference between the two analog-digital converter ADC #i and ADC #j, and correct sensing data obtained from the two source driver integrated circuits SDIC #i and SDIC #j on the basis of the recognized difference. Thus, the organic light emitting display device 100 can reduce or suppress an image variation between the two source driver integrated circuits SDIC #i and SDIC #j.

In the present exemplary embodiments, the first analog-digital converter ADC #i included in the first source driver integrated circuit SDIC #i and the second analog-digital converter ADC #j included in the second source driver integrated circuit SDIC #j convert a voltage of one sensing line into a digital value (sensing value) at the same time, the first neighbor sensing value obtained from the first analog-digital converter ADC #i included in the first source driver integrated circuit SDIC #i and the second sensing value obtained from the second analog-digital converter ADC #j included in the second source driver integrated circuit SDIC #j are compared. If there is a difference, it is recognized as an analog-digital conversion difference (sensing difference).

Hereinafter, a method for recognizing and compensating a sensing difference between the two source driver integrated circuits SDIC #i and SDIC #j, i.e., an analog-digital conversion difference between the two analog-digital converter ADC #i and ADC #j and a structure therefor will be described in more detail with reference to the drawings.

Figure 7:
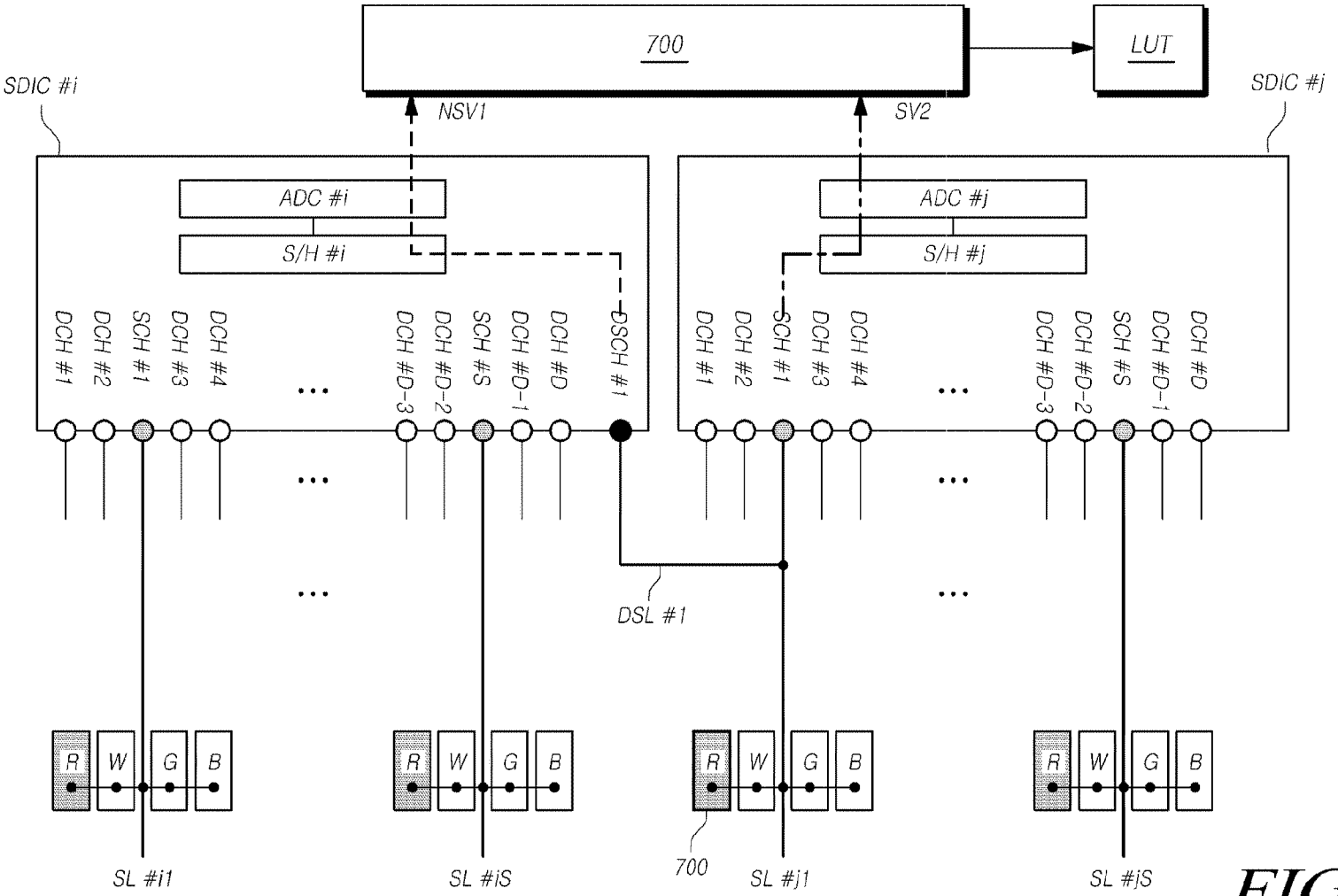
FIG. 7 is a diagram provided to explain a first sensing difference sensing structure for sensing a sensing difference between source driver integrated circuits according to the present exemplary embodiments and a method for sensing and correcting a sensing difference using the first sensing difference sensing structure.
Figure 8:
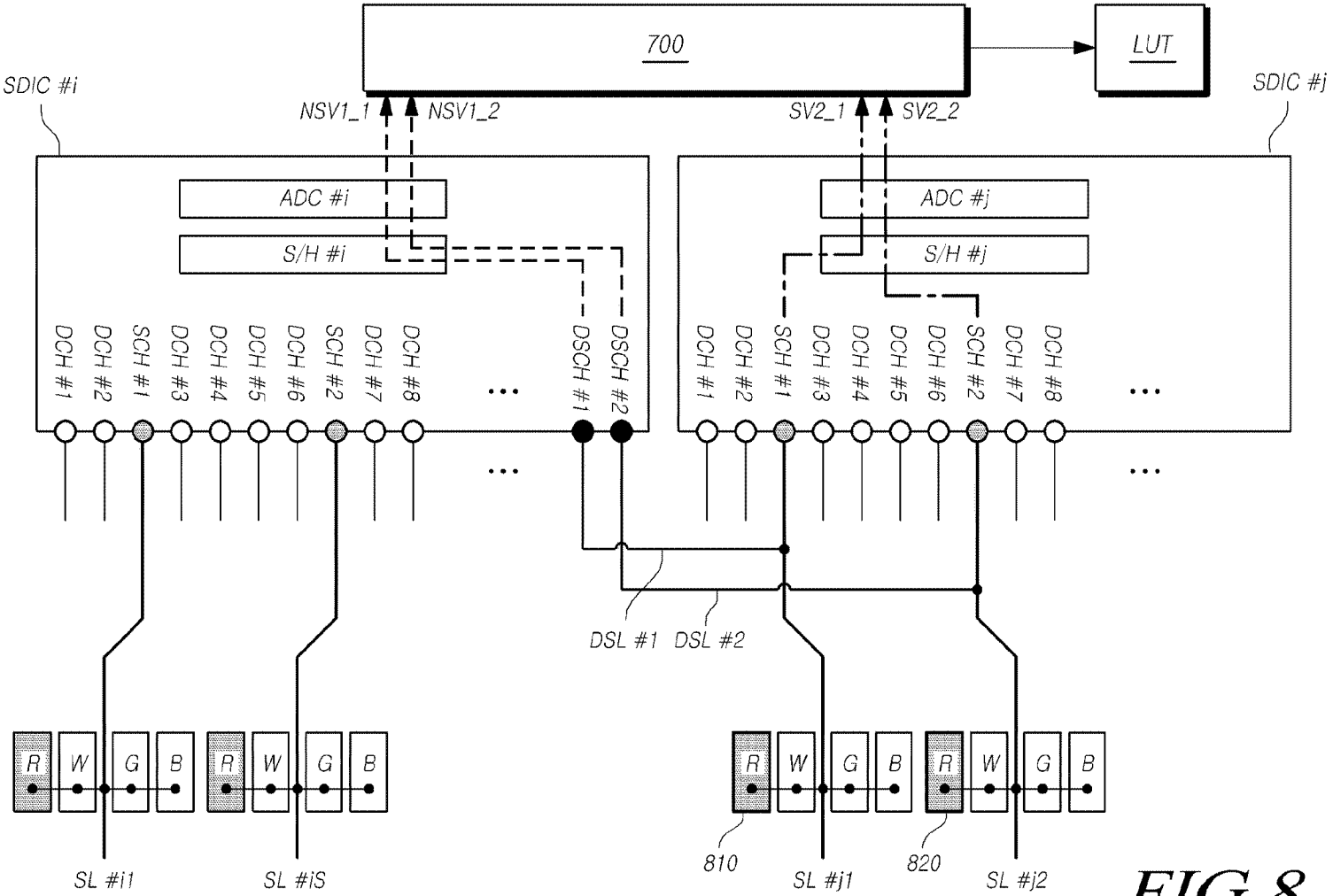
FIG. 8 is a diagram provided to explain a second sensing difference sensing structure for sensing a sensing difference between source driver integrated circuits according to the present exemplary embodiments and a method for sensing and correcting a sensing difference using the second sensing difference sensing structure.
Figure 9:
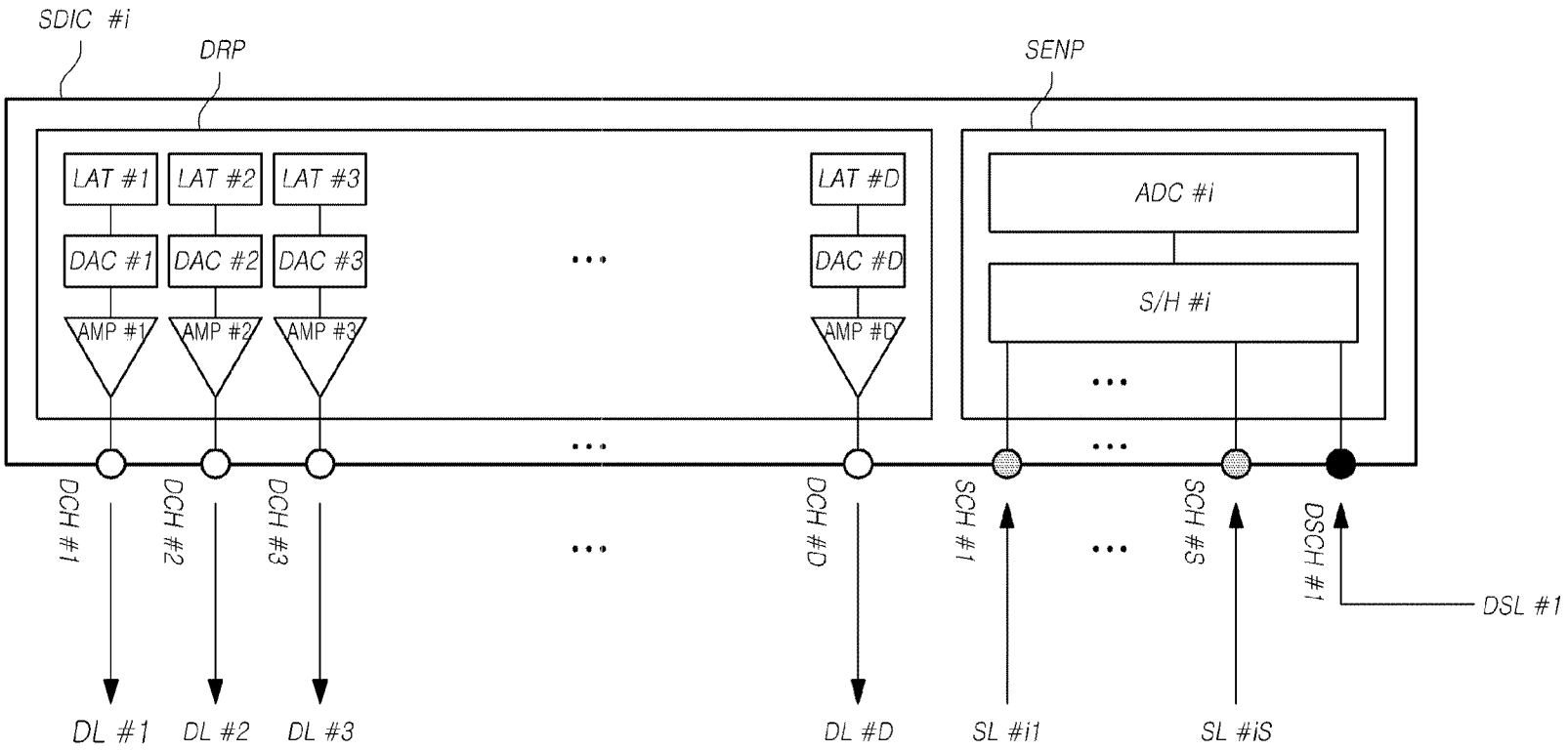
FIG. 9 is a diagram illustrating a source driver integrated circuit in the first sensing difference sensing structure for sensing a sensing difference between source driver integrated circuits according to the present exemplary embodiments.
Figure 10:
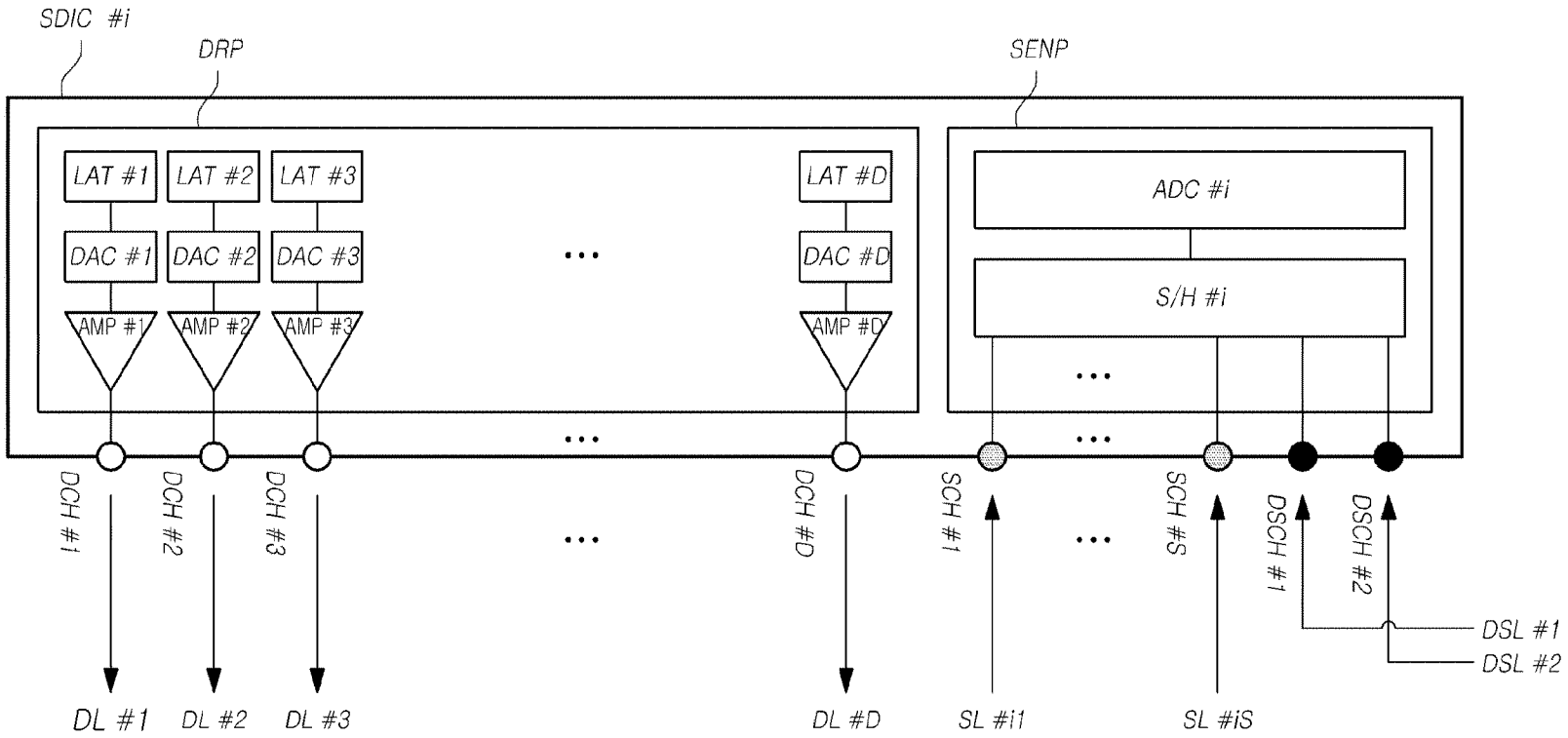
FIG. 10 is a diagram illustrating a source driver integrated circuit in the second sensing difference sensing structure for sensing a sensing difference between source driver integrated circuits according to the present exemplary embodiments.

FIG. 7 is a diagram provided to explain a first sensing difference sensing structure for sensing a sensing difference between the two source driver integrated circuits SDIC #i and SDIC #j according to the present exemplary embodiments and a method for sensing and correcting a sensing difference using the first sensing difference sensing structure, and FIG. 8 is a diagram provided to explain a second sensing difference sensing structure for sensing a sensing difference between the two source driver integrated circuits SDIC #i and SDIC #j according to the present exemplary embodiments and a method for sensing and correcting a sensing difference using the second sensing difference sensing structure. Further, FIG. 9 is a diagram illustrating a source driver integrated circuit in the first sensing difference sensing structure for sensing a sensing difference between the two source driver integrated circuits SDIC #i and SDIC #j according to the present exemplary embodiments, and FIG. 10 is a diagram illustrating a source driver integrated circuit in the second sensing difference sensing structure for sensing a sensing difference between the two source driver integrated circuits SDIC #i and SDIC #j according to the present exemplary embodiments.

Referring to FIG. 7, the organic light emitting display device 100 according to the present exemplary embodiments may include one difference sensing line DSL #1 configured to electrically connect one second sensing line SL #j1 of S number of second sensing lines SL #j1, . . . , SL #jS connected to the second source driver integrated circuit SDIC #j to the first source driver integrated circuit SDIC #i.

Otherwise, referring to FIG. 8, the organic light emitting display device 100 according to the present exemplary embodiments may include two difference sensing lines DSL #1 and DSL #2 configured to electrically connect two second sensing lines SL #j1 and SL #j2 of S number of second sensing lines SL #j1, . . . , SL #jS connected to the second source driver integrated circuit SDIC #j to the first source driver integrated circuit SDIC #i.

FIG. 8 illustrates only two difference sensing lines DSL #1 and DSL #2 for convenience in explanation. Three or more difference sensing lines DSL #1, DSL #2, . . . may be present.

That is, the organic light emitting display device 100 according to the present exemplary embodiments may include three or more difference sensing lines DSL #1, DSL #2, . . . configured to electrically connect three or more second sensing lines SL #j1, SL #j2, . . . of S number of second sensing lines SL #j1, . . . , SL #jS connected to the second source driver integrated circuit SDIC #j to the first source driver integrated circuit SDIC #i.

Therefore, the organic light emitting display device 100 according to the present exemplary embodiments may include at least one difference sensing line DSL #1, . . . configured to electrically connect at least one second sensing line SL #j1, . . . of S number of second sensing lines SL #j1, . . . , SL #jS connected to the second source driver integrated circuit SDIC #j to the first source driver integrated circuit SDIC #i.

In the following, for convenience in explanation, there will be described a method for recognizing and compensating a sensing difference (analog-digital conversion difference) with respect to "a first sensing difference sensing structure" in which one second sensing line SL #j1 of S number of second sensing lines SL #j1, . . . , SL #jS connected to the second source driver integrated circuit SDIC #j is electrically connected to the first source driver integrated circuit SDIC #i through one difference sensing line DSL #1 and "a second sensing difference sensing structure" in which two second sensing lines SL #j1 and SL #j2 of S number of second sensing lines SL #j1, . . . , SL #jS connected to the second source driver integrated circuit SDIC #j are electrically connected to the first source driver integrated circuit SDIC #i through two difference sensing lines DSL #1 and DSL #2.

Herein, at least one second sensing line SL #j1, . . . of S number of second sensing lines SL #j1, . . . , SL #jS connected to the second source driver integrated circuit SDIC #j electrically connected to the first source driver integrated circuit SDIC #i through at least one difference sensing line DSL #1, . . . may be a second sensing line adjacent to the first source driver integrated circuit SDIC #i.

Referring to FIG. 7 and FIG. 8, the first source driver integrated circuit SDIC #i as any one source driver integrated circuit included in the data driver 120 includes the first analog-digital converter ADC #i electrically connected to S number of first sensing lines SL #i1, . . . , SL #iS and electrically connected to at least one difference sensing line DSL #1, . . . .

The second source driver integrated circuit SDIC #j as any another source driver integrate circuit included in the data driver 120 includes the second analog-digital converter ADC #j electrically connected to S number of second sensing lines SL #j1, . . . , SL #jS.

If the second source driver integrated circuit SDIC #j is an outermost source driver integrated circuit of which only one side is adjacent to another source driver integrated circuit, the second analog-digital converter ADC #j is not electrically connected to at least one difference sensing line DSL #1, . . . .

If the second source driver integrated circuit SDIC #j is a source driver integrated circuit of which both sides are adjacent to other source driver integrated circuits, the second analog-digital converter ADC #j may be electrically connected to at least one difference sensing line DSL #1, . . . .

According to the above description, the first analog-digital converter ADC #i included in the first source driver integrated circuit SDIC #i is electrically connected to at least one second sensing line SL #j1, . . . electrically connected to the adjacent second source driver integrated circuit SDIC #j through at least one difference sensing line DSL #1, . . . and senses sub-pixel characteristics of sub-pixels 700, 810, and 820 which are data-driven by the adjacent second source driver integrated circuit SDIC #j.

Referring to FIG. 7 and FIG. 8, the first source driver integrated circuit SDIC #i may further include the first sample and hold circuit S/H #i configured to store and hold a voltage of each of S number of first sensing lines SL #i1, . . . , SL #iS and at least one difference sensing line DSL #1, . . . between the S number of first sensing lines SL #i1, . . . , SL #iS/the at least one difference sensing line DSL #1, . . . and the first analog-digital converter ADC #i.

The second source driver integrated circuit SDIC #j may further include the second sample and hold circuit S/H #j configured to store a voltage of each of S number of second sensing lines SL #j1, . . . , SL #jS between the S number of second sensing lines SL #j1, . . . , SL #jS and the second analog-digital converter ADC #j.

According to the above description, the first sample and hold circuit S/H #i in the first source driver integrated circuit SDIC #i is electrically connected to at least one second sensing line SL #j1, . . . electrically connected to the adjacent second source driver integrated circuit SDIC #j through at least one difference sensing line DSL #1, . . . and stores and holds voltages reflecting the sub-pixel characteristics of the sub-pixels 700, 810, and 820 which are data-driven by the adjacent second source driver integrated circuit SDIC #j.

Referring to FIG. 7 and FIG. 8, the organic light emitting display device 100 according to the present exemplary embodiments may further include an analog-digital conversion difference correction unit 700 configured to recognize an analog-digital conversion difference (sensing difference) between the first analog-digital converter ADC #i and the second analog-digital converter ADC #j and perform an analog-digital conversion difference correction process on the basis of information of the recognized analog-digital conversion difference.

The analog-digital conversion difference correction process performed by the analog-digital conversion difference correction unit 700 may refer to a process of modifying sensing data of sub-pixel characteristics to be received on the basis of the recognized analog-digital conversion difference.

To this end, the analog-digital conversion difference correction unit 700 may store the information of the recognized analog-digital conversion difference or information of analog-digital conversion characteristics (for example, offset, gain, and the like.) in a look-up table LUT.

Referring to FIG. 7, in the first sensing difference sensing structure, during a sensing period for sensing characteristics of an R sub-pixel 700 among four sub-pixels R, W, G, and B respectively connected to sensing lines, the second sample and hold circuit S/H #j in the second source driver integrated circuit SDIC #j stores and holds an analog voltage value of a second sensing line SL #j1 corresponding to a voltage value of the first node N1 of the driving transistor DRT within the R sub-pixel 700, which is a sensing target during the current sensing period, among the four sub-pixels R, W, G, and B electrically connected to the second sensing line SL #j1.

Then, the second analog-digital converter ADC #j in the second source driver integrated circuit SDIC #j converts the analog voltage value of the second sensing line SL #j1 stored and held by the second sample and hold circuit S/H #j into a digital value to obtain a second sensing value SV2.

Further, referring to FIG. 7, during the same sensing period, the first sample and hold circuit S/H #i in the first source driver integrated circuit SDIC #i stores and holds an analog voltage value of the second sensing line SL #j1 electrically connected to the R sub-pixel 700, which is data-driven by the second source driver integrated circuit SDIC #j, through a difference sensing channel DSCH #1.

Then, the first analog-digital converter ADC #i included in the first source driver integrated circuit SDIC #i converts the analog voltage value of the second sensing line SL #j1 stored and held by the first sample and hold circuit S/H #i into a digital value to obtain "a first neighbor sensing value NSV1".

Herein, the term "neighbor sensing value" means a sensing value obtained by converting an analog voltage (a voltage of a sensing line connected to a neighboring source driver integrated circuit) applied through a difference sensing channel into a digital value by a source driver integrated circuit.

The second source driver integrated circuit SDIC #j transmits second sensing data including the second sensing value SV2 obtained through an analog-digital conversion by the second analog-digital converter ADC #j to the analog-digital conversion difference correction unit 700.

Herein, the second source driver integrated circuit SDIC #j generates the second sensing value SV2 and also drives a sub-pixel corresponding to sub-pixel characteristics reflected by the second sensing value SV2.

Further, first sensing data including the first neighbor sensing value NSV1 obtained through an analog-digital conversion by the first analog-digital converter ADC #i included in the first source driver integrated circuit SDIC #i are transmitted to the analog-digital conversion difference correction unit 700.

Herein, although the first source driver integrated circuit SDIC #i generates the first neighbor sensing value NSV1, the second source driver integrated circuit SDIC #j drives a sub-pixel corresponding to sub-pixel characteristics reflected by the first neighbor sensing value NSV1.

If a difference between the second sensing value SV2 included in the second sensing data and the first neighbor sensing value NSV1 included in the first sensing data is equal to or greater than a predetermined threshold value (for example, 0 or more), the analog-digital conversion difference correction unit 700 recognizes that there is a sensing difference between the first source driver integrated circuit SDIC #i and the second source driver integrated circuit SDIC #j, i.e., an analog-digital conversion difference between the first analog-digital converter ADC #i and the second analog-digital converter ADC #j and then performs an analog-digital conversion difference correction process (sensing difference correction process).

Referring to FIG. 8, in the second sensing difference sensing structure, during a sensing period for sensing characteristics of R sub-pixels 810 and 820 among four sub-pixels R, W, G, and B respectively connected to sensing lines, the second sample and hold circuit S/H #j in the second source driver integrated circuit SDIC #j stores and holds analog voltage values of two second sensing lines SL #j1 and SL #j2 corresponding to voltage values of the first nodes N1 of the driving transistors DRT within the R sub-pixels 810 and 820, which are sensing targets during the current sensing period, among the four sub-pixels R, W, G, and B electrically connected to the two second sensing lines SL #j1 and SL #j2, respectively.

Then, the second analog-digital converter ADC #j in the second source driver integrated circuit SDIC #j converts the analog voltage values of the two second sensing lines SL #j1 and SL #j2 stored and held by the second sample and hold circuit S/H #j into digital values to obtain two second sensing values SV2_1 and SV2_2.

Further, referring to FIG. 8, during the same sensing period, the first sample and hold circuit S/H #i in the first source driver integrated circuit SDIC #i stores and holds analog voltage values of the two second sensing lines SL #j1 and SL #j2 electrically connected to the two R sub-pixels 810 and 820, which are data-driven by the second source driver integrated circuit SDIC #j, through two difference sensing channels DSCH #1 and DSCH #2, respectively.

Then, the first analog-digital converter ADC #i in the first source driver integrated circuit SDIC #i converts the analog voltage values of the two second sensing lines SL #j1 and SL #j2 stored and held by the first sample and hold circuit S/H #i into digital values to obtain two first neighbor sensing values NSV1_1 and NSV1_2, respectively.

The second source driver integrated circuit SDIC #j transmits second sensing data including the two second sensing values SV2_1 and SV2_2 obtained through an analog-digital conversion by the second analog-digital converter ADC #j to the analog-digital conversion difference correction unit 700.

Further, first sensing data including the two first neighbor sensing values NSV1_1 and NSV1_2 obtained through an analog-digital conversion by the first analog-digital converter ADC #i included in the first source driver integrated circuit SDIC #i are transmitted to the analog-digital conversion difference correction unit 700.

If a difference between an average value of the two second sensing values SV2_1 and SV2_2 included in the second sensing data and an average value of the two first neighbor sensing values NSV1_1 and NSV1_2 included in the first sensing data is equal to or greater than a predetermined threshold value, the analog-digital conversion difference correction unit 700 recognizes that there is a sensing difference between the first source driver integrated circuit SDIC #i and the second source driver integrated circuit SDIC #j, i.e., an analog-digital conversion difference between the first analog-digital converter ADC #i and the second analog-digital converter ADC #j and then performs an analog-digital conversion difference correction process (sensing difference correction process).

According to the above description, the second analog-digital converter ADC #j included in the second source driver integrated circuit SDIC #j and the first analog-digital converter ADC #i included in the first source driver integrated circuit SDIC #i perform analog-digital conversions to the same voltage of one second sensing line SL #j1 at the same time.

Thus, it is possible to recognize a sensing difference (i.e., analog-digital conversion difference) between the first analog-digital converter ADC #i included in the first source driver integrated circuit SDIC #i and the second analog-digital converter ADC #j included in the second source driver integrated circuit SDIC #j.

Further, if the number of second sensing lines electrically connected to the first analog-digital converter ADC #i included in the first source driver integrated circuit SDIC #i among S number of second sensing lines SL #j1, . . . , SL #jS connected to the second source driver integrated circuit SDIC #j is increased, i.e., if the number of difference sensing lines is increased, accuracy in recognition of a sensing difference can be increased.

Referring to FIG. 7 and FIG. 8, S number of first sensing lines SL #i1, . . . , SL #iS (S is a natural number of 1 or more in FIG. 7, and S is a natural number of 2 or more in FIG. 8) are electrically connected to a first sub-pixel which is data-driven by the first source driver integrated circuit SDIC #i.

Likewise, S number of second sensing lines SL #j1, . . . , SL #jS are electrically connected to second sub-pixels (including 700, 810, and 820) which are data-driven by the second source driver integrated circuit SDIC #j.

In comparison, referring to FIG. 7 and FIG. 8, at least one difference sensing line DSL #1, DSL #2 . . . may be electrically connected to at least one difference sensing channel DSCH #1, DSCH #2, . . . of the first source driver integrated circuit SDIC #i and at least one sensing channel SCH #1, SCH #2, . . . of the second source driver integrated circuit SDIC #j.

Referring to FIG. 7 and FIG. 8, at least one difference sensing line DSL #1, DSL #2 . . . is not connected to S number of first sensing lines SL #i1, . . . , SL #iS connected to the first source driver integrated circuit SDIC #i. That is, at least one difference sensing line DSL #1, DSL #2 . . . is not electrically connected to the first sub-pixel which is data-driven by the first source driver integrated circuit SDIC #i.

Meanwhile, at least one difference sensing line DSL #1, DSL #2 . . . is connected to at least one second sensing line SL #j1, SL #j2, . . . of S number of second sensing lines SL #j1, . . . , SL #jS connected to the second source driver integrated circuit SDIC #j. That is, at least one difference sensing line DSL #1, DSL #2 . . . is electrically connected to the second sub-pixels 700, 810, and 820 which are data-driven by the second source driver integrated circuit SDIC #j.

The analog-digital conversion difference correction unit 700 receives the first sensing data including the first neighbor sensing value obtained by converting an analog voltage value of each of at least one second sensing line into a digital value from the first analog-digital converter ADC #i included in the first source driver integrated circuit SDIC #i through at least one difference sensing line and receives the second sensing data including the second sensing value obtained by converting an analog voltage value of at least one second sensing line into a digital value from the second analog-digital converter ADC #j included in the second source driver integrated circuit SDIC #j, and compares the first sensing data and the second sensing data. Then, the analog-digital conversion difference correction unit 700 recognizes an analog-digital conversion difference between the first analog-digital converter ADC #i and the second analog-digital converter ADC #j on the basis of a comparison result and then performs an analog-digital conversion difference correction process.

Referring to FIG. 7, the analog-digital conversion difference correction unit 700 receives the first sensing data including the first neighbor sensing value NSV1 obtained by converting an analog voltage value of a second sensing line SL #j1 into a digital value from the first analog-digital converter ADC #i included in the first source driver integrated circuit SDIC #i through one difference sensing line DSL #1 and receives the second sensing data including the second sensing value SV2 obtained by converting an analog voltage value of one second sensing line SL #j1 into a digital value from the second analog-digital converter ADC #j included in the second source driver integrated circuit SDIC #j, and compares the first sensing data and the second sensing data. Then, the analog-digital conversion difference correction unit 700 recognizes an analog-digital conversion difference between the first analog-digital converter ADC #i and the second analog-digital converter ADC #j on the basis of a comparison result and then performs an analog-digital conversion difference correction process.

As illustrated in FIG. 8, if the number of difference sensing lines is 2 or more, the analog-digital conversion difference correction unit 700 receives the first sensing data including the two first neighbor sensing values NSV1_1 and NSV1_2 obtained by converting analog voltage values of two second sensing lines SL #j1 and SL #j2 into digital values from the first analog-digital converter ADC #i included in the first source driver integrated circuit SDIC #i through two difference sensing lines DSL #1 and DSL #2 and receives the second sensing data including the two second sensing value SV2_1 and SV2_2 obtained by converting analog voltage values of two second sensing lines SL #j1, SL #j2 into digital values from the second analog-digital converter ADC #j included in the second source driver integrated circuit SDIC #j, and compares the first sensing data and the second sensing data. Then, the analog-digital conversion difference correction unit 700 recognizes an analog-digital conversion difference between the first analog-digital converter ADC #i and the second analog-digital converter ADC #j on the basis of a comparison result and then performs an analog-digital conversion difference correction process.

More specifically, the analog-digital conversion difference correction unit 700 calculates a first average sensing value by averaging two or more first neighbor sensing values NSV1_1 and NSV1_2 included in the first sensing data received from the first analog-digital converter ADC #i and calculates a second average sensing value by averaging two or more sensing values SV2_1 and SV2_2 included in the second sensing data received from the second analog-digital converter ADC #j. Then, the analog-digital conversion difference correction unit 700 recognizes an analog-digital conversion difference on the basis of a difference between the calculated first average sensing value and second average sensing value. Further, the analog-digital conversion difference correction unit 700 performs an analog-digital conversion difference correction process by correcting at least one of sensing data (sensing data including sensing values obtained through S number of sensing channels SCH #1, . . . , SCH #S) to be received from the first analog-digital converter ADC #i and sensing data (sensing data including sensing values obtained through S number of sensing channels SCH #1, . . . , SCH #S) to be received from the second analog-digital converter ADC #j on the basis of the recognized analog-digital conversion difference.

According to the above description, through a sensing difference correction for reducing or removing a sensing difference on the basis of the recognized sensing difference (analog-digital conversion difference) between the source driver integrated circuits SDIC #i and SDIC #j, accuracy in sensing data of sub-pixel characteristics can be increased. Therefore, a sub-pixel characteristic compensation process can be properly performed, and, thus, a block dim phenomenon can be suppressed and an image quality can be improved.

Meanwhile, unlike the difference sensing line connection structure illustrated in FIG. 8, a difference sensing line DSL #1 may connect a difference sensing channel DSCH #1 of the first source driver integrated circuit SDIC #i and a second sensing line SL #2 electrically connected to the second source driver integrated circuit SDIC #j, and a difference sensing line DSL #2 may connect a difference sensing channel DSCH #2 of the first source driver integrated circuit SDIC #i and a second sensing line SL #1 electrically connected to the second source driver integrated circuit SDIC #j.

Further, meanwhile, in an example illustrated in FIG. 8, when the display panel 110 is viewed from the top, a portion in a row direction of the difference sensing line DSL #1 is designed to be closer to the source driver integrated circuits SDIC #i and SDIC #j than a portion in a row direction of the difference sensing line DSL #2.

Thus, there may be two signal line overlap points including a first point where the two difference sensing lines DSL #1 and DSL #2 are overlapped and a second point where the difference sensing line DSL #2 and the second sensing line SL #1 are overlapped.

Therefore, unlike the example as illustrated in FIG. 8, the portion in the row direction of the difference sensing line DSL #2 may be designed to be closer to the source driver integrated circuits SDIC #i and SDIC #j than the portion in the row direction of the difference sensing line DSL #1, so that only one signal line overlap point (second point) may be present.

Hereinafter, a source driver integrated circuit structure that enables recognition of a sensing difference between source driver integrated circuits SDIC #i and SDIC #j will be described with reference to FIG. 9 and FIG. 10. Herein, the first source driver integrated circuit SDIC #i is exemplified.

Referring to FIG. 9 and FIG. 10, the first source driver integrated circuit SDIC #i may include a driving part DRP for driving of data with respect to D number of sub-pixel columns connected to D (D≥1) number of data lines DL #1, . . . , DL #D and a sensing part SENP for sensing of sub-pixel characteristics with respect to the D number of sub-pixel columns connected to the D (D≥1) number of data lines DL #1, . . . , DL #D.

Referring to FIG. 9 and FIG. 10, the driving part DRP of the first source driver integrated circuit SDIC #i is connected to the D number of data lines DL #1, . . . , DL #D, and may include D number of first output buffers AMP #1, . . . , AMP #D corresponding to D number of data channels DCH #1, . . . , DCH #D, D number of first digital-analog converters DAC #1, . . . , DAC #D corresponding to the D number of data channels DCH #1, . . . , DCH #D, D number of first latch circuits LAT #1, . . . , LAT #D corresponding to the D number of data channels DCH #1, . . . , DCH #D, and the like.

The number D of data channels for one first source driver integrated circuit SDIC #i (i=1, . . . , K, K is a natural number of 2 or more) is determined by the total number N of data lines and the total number K of source driver integrated circuits (D=N/K). For example, in case of N=1920 and K=10, D is 192.

Referring to FIG. 9 and FIG. 10, the sensing part SENP of the first source driver integrated circuit SDIC #i is electrically connected to S number of first sensing lines SL #i1, . . . , SL # iS through S (S≥1) number of sensing channels SCH #1, . . . , SCH #S, and may include a first analog-digital converter ADC #i electrically connected to at least one difference sensing line DSL #1, . . . through at least one difference sensing channel DSCH #1, . . . .

The number S of sensing channels for one first source driver integrated circuit SDIC #i (i=1, . . . , K, K is a natural number of 2 or more) is determined by a sensing line share ratio R and the number D of data channels for one source driver integrated circuit (S=R*D). For example, in case of N=1920, K=10 and R=¼, D is 192 and S=R*D=(¼)*192 is 48.

Since the first analog-digital converter ADC #i is electrically connected to at least one difference sensing line DSL #1, . . . through at least one difference sensing channel DSCH #1, . . . , it can also be electrically connected to at least one second sensing line SL #i1, . . . connected to at least one difference sensing line DSL #1, . . . of S number of second sensing lines SL #j1, . . . , SL #jS connected to the second source driver integrated circuit SDIC #j.

Each of K number of source driver integrated circuits SDIC #i, . . . , SDIC #K within the data driver 120 can be implemented in the same manner as the above-described first source driver integrated circuit SDIC #i.

According to the above description, it is possible to provide a source driver integrated circuit capable of accurately recognizing a sensing difference between source driver integrated circuits while maintaining the existing components for data driving and sub-pixel characteristic sensing.

Hereinafter, a method for implementing at least one difference sensing line DSL #1, . . . in the organic light emitting display device 100 according to the present exemplary embodiments will be described with reference to FIG. 11 through FIG. 17.

Figure 11:
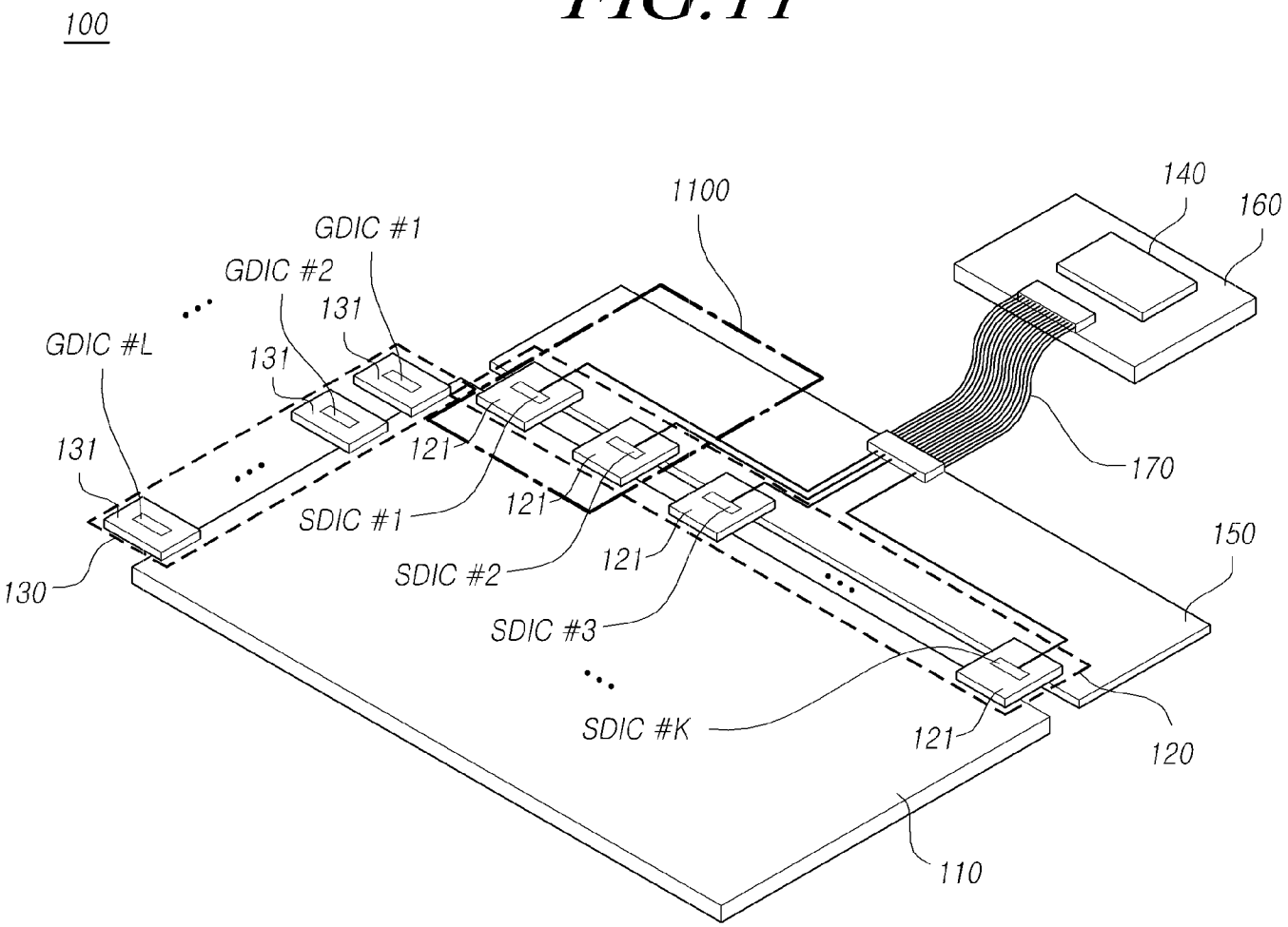
FIG. 11 is an exemplary diagram illustrating system implementation of the organic light emitting display device according to the present exemplary embodiments.

FIG. 11 is an exemplary diagram illustrating system implementation of the organic light emitting display device 100 according to the present exemplary embodiments.

The organic light emitting display device 100 schematically illustrated in FIG. 1 can be implemented as illustrated in FIG. 11.

Each of two or more source driver integrated circuits SDIC #1 to SDIC #K (K is a natural number of 2 or more) included in the data driver 120 may be connected to a bonding pad of the organic light emitting display panel 110 through a Tape Automated Bonding (TAB) method or a Chip On Glass (COG) method, or directly disposed in the organic light emitting display panel 110, or may be integrated and disposed in the organic light emitting display panel 110 if necessary.

Otherwise, each of the two or more source driver integrated circuits SDIC #1 to SDIC #K may be implemented in a Chip On Film (COF) type as illustrated in FIG. 11.

In this case, one end of each of the two or more source driver integrated circuits SDIC #1 to SDIC #K may be bonded to a source printed circuit board 150 and the other end may be mounted on a film 121 bonded to the organic light emitting display panel 110. Herein, the film 121 may be a flexible film.

Although FIG. 11 illustrates one source printed circuit board 150, two or more source printed circuit boards 150 may be present.

Referring to FIG. 11, each of one or more gate driver integrated circuits GDIC #1 to GDIC #L (L is a natural number of 1 or more) included in the gate driver 130 may be connected to a bonding pad of the organic light emitting display panel 110 through a Tape Automated Bonding (TAB) method or a Chip On Glass (COG) method, or implemented in a Gate In Panel (GIP) type and directly disposed in the organic light emitting display panel 110, or may be integrated and disposed in the organic light emitting display panel 110 if necessary.

Otherwise, each of the one or more gate driver integrated circuits GDIC #1 to GDIC #L may be implemented in a Chip On Film (COF) type.

In this case, each of the gate driver integrated circuits GDIC #1 to GDIC #L may be mounted on a film 131 connected to the organic light emitting display panel 110. Herein, the film 131 may be a flexible film.

Each of the one or more gate driver integrated circuits GDIC #1 to GDIC #L may include a shift register, a level shifter, and the like.

Referring to FIG. 11, for example, the controller 140 may be disposed on the control printed circuit board 160.

The control printed circuit board 160 may be connected to at least one source printed circuit board 150 through a connector 170 such as a flexible flat cable (FFC) or a flexible printed circuit (FPC).

Further, in the control printed circuit board 160, a power controller (not illustrated) configured to supply a voltage or current to the organic light emitting display panel 110, the data driver 120, the gate driver 130, and the like, or control a voltage or current to be supplied may be further disposed.

The source printed circuit board 150 and the control printed circuit board 160 may be formed as one printed circuit board.

At least one difference sensing line may be located in the organic light emitting display panel 110, or may be located in the source printed circuit board 150 electrically connected to the first source driver integrated circuit SDIC #i and the second source driver integrated circuit SDIC #j.

Figure 12:
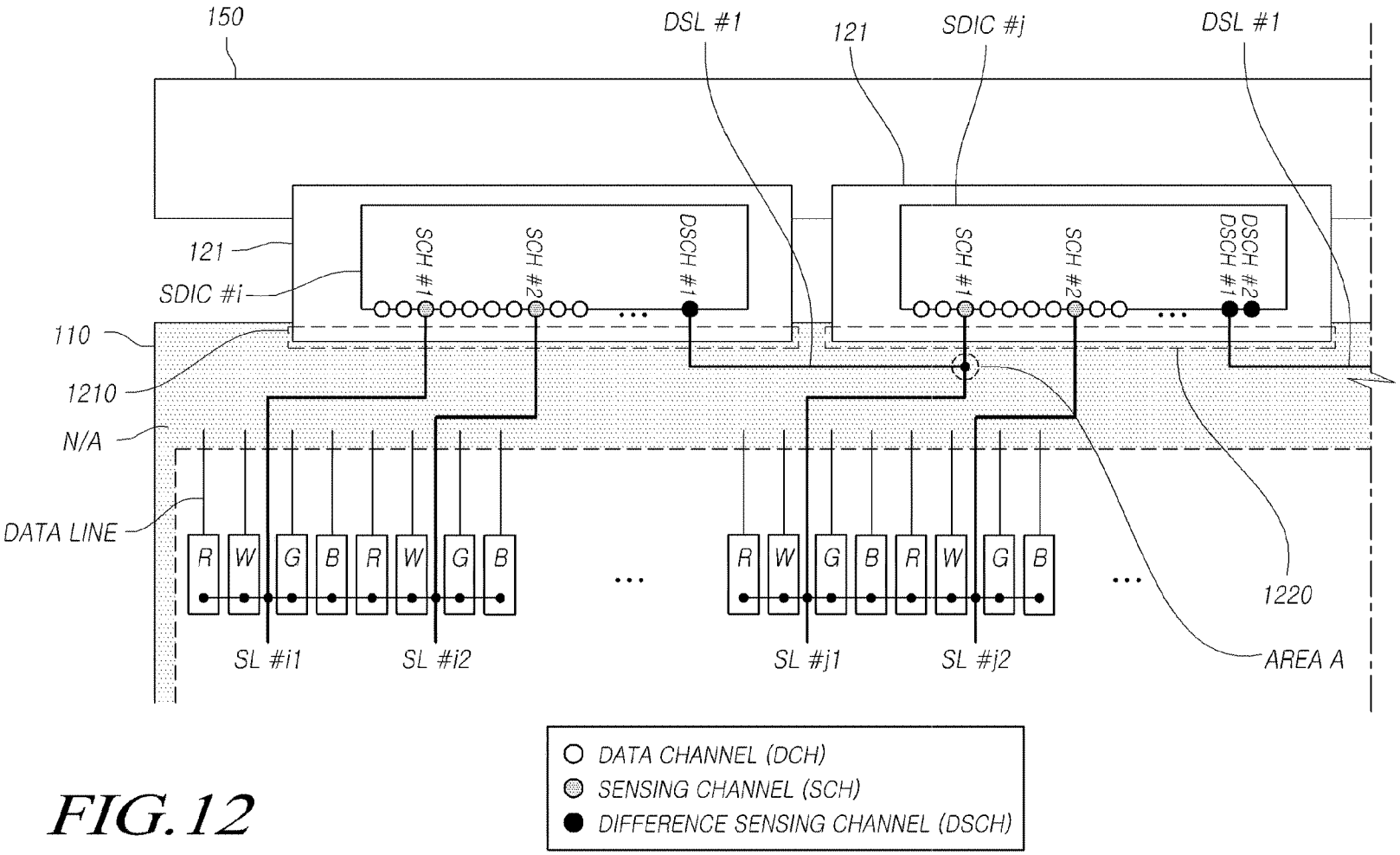
FIG. 12 and FIG. 13 are exemplary diagrams illustrating that at least one difference sensing line for sensing a sensing difference between two source driver integrated circuits is provided in an organic light emitting display panel according to the present exemplary embodiments.
Figure 13:
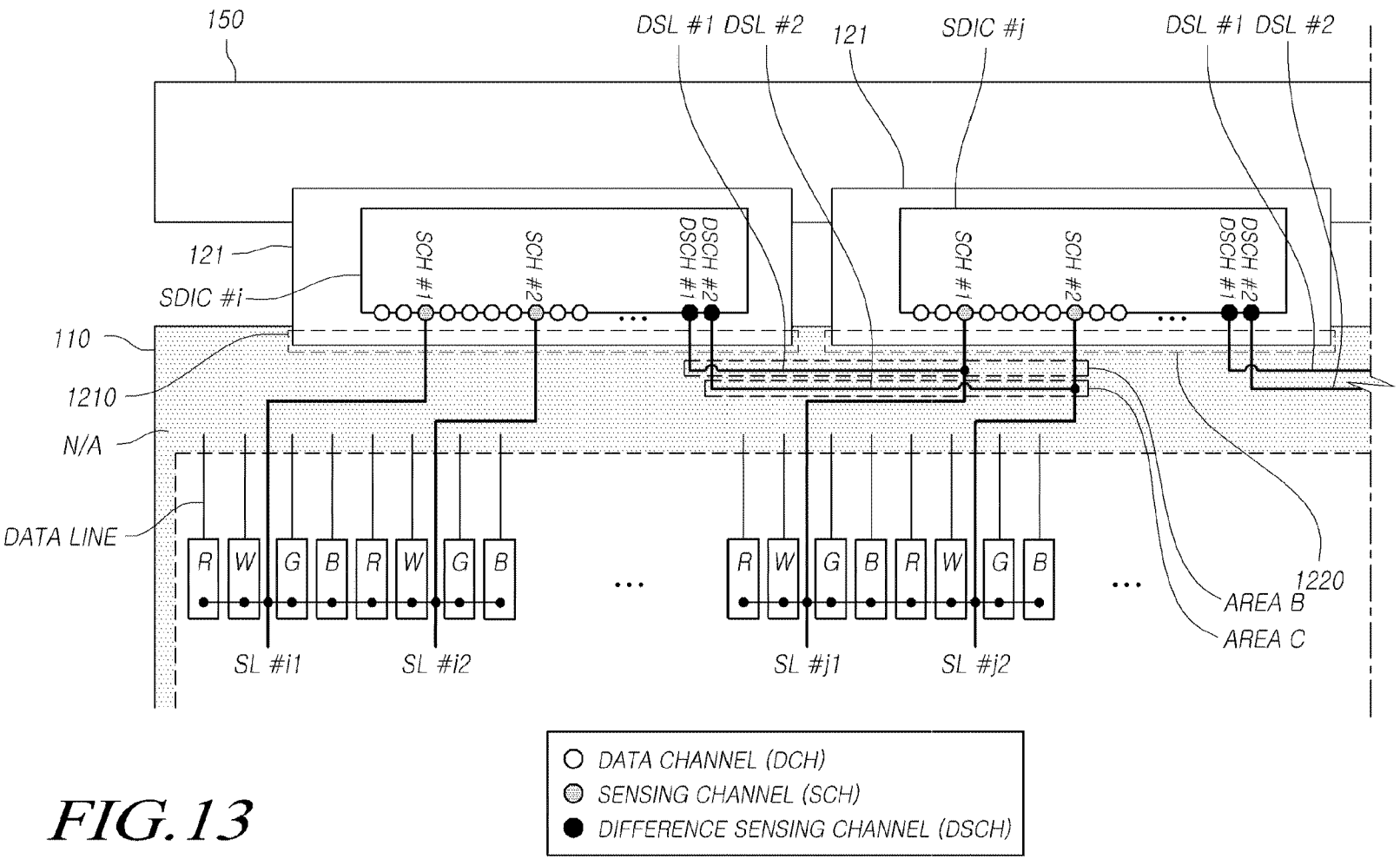
Figure 14:
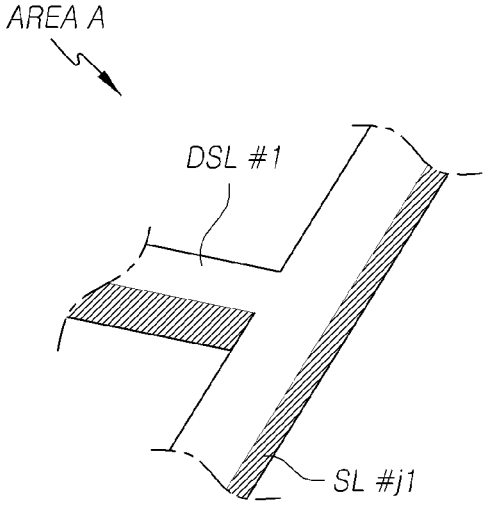
FIG. 14 and FIG. 15 are diagrams illustrating a structure of an area where at least one difference sensing line is located in the organic light emitting display panel according to the present exemplary embodiments.
Figure 15:
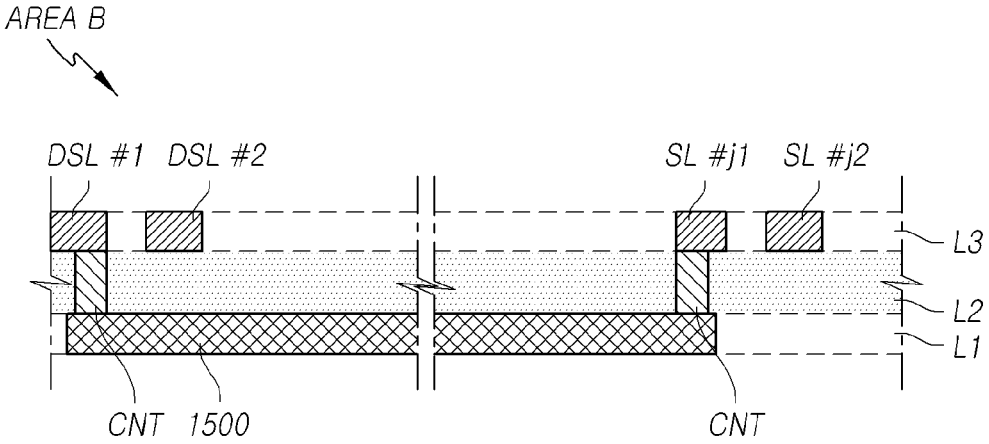
Figure 15:
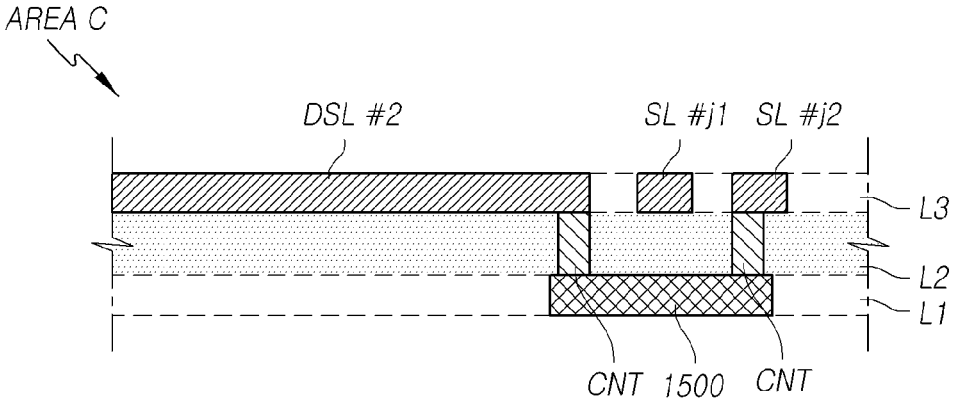

FIG. 12 and FIG. 13 are exemplary diagrams illustrating that at least one difference sensing line for sensing a sensing difference between the two source driver integrated circuits SDIC #i and SDIC #j is provided in the organic light emitting display panel 110 according to the present exemplary embodiments, and FIG. 14 and FIG. 15 are diagrams illustrating a structure of an area where at least one difference sensing line is located in the organic light emitting display panel 110 according to the present exemplary embodiments.

Referring to FIG. 12 and FIG. 13, at least one difference sensing line DSL #1, . . . disposed in each of the two source driver integrated circuits SDIC #i and SDIC #j may be located in the organic light emitting display panel 110.

Referring to FIG. 12 and FIG. 13, at least one difference sensing line DSL #1, . . . is located adjacent to two driver connection areas 1210 and 1220 connected to the two source driver integrated circuits SDIC #i and SDIC #j in the organic light emitting display panel 110.

As such, if at least one difference sensing line DSL #1, . . . disposed in each of the two source driver integrated circuits SDIC #i and SDIC #j is located in the organic light emitting display panel 110, the at least one difference sensing line DSL #1, . . . can be formed adjacent to the two driver connection areas 1210 and 1220 together with other patterns (electrodes, signal lines, and the like.) during a panel manufacturing process. Thus, it is possible to form a structure for recognizing a sensing difference without an additional process.

The at least one difference sensing line DSL #1, . . . located in the organic light emitting display panel 110 may be located in a non-active area N/A corresponding to an outer peripheral area of an active area A/A which is a display area of the organic light emitting display panel 110.

If there is one difference sensing line as illustrated in FIG. 12, one difference sensing line DSL #1 may be configured as illustrated in FIG. 14 and disposed in the organic light emitting display panel 110.

FIG. 14 is a schematic diagram enlarging an area A where a difference sensing line DSL #1 is connected to the second sensing line SL #j1 as illustrated in FIG. 12.

Referring to FIG. 14, in the area A, one difference sensing line DSL #1 electrically connected to the first source driver integrated circuit SDIC #i and one second sensing line SL #j1 of S number of second sensing lines SL #j1, . . . , SL #jS electrically connected to the second source driver integrated circuit SDIC #j may be formed as one body on the same layer.

As described above, if one difference sensing line DSL #1 is present in each of the two source driver integrated circuits SDIC #i and SDIC #j, one second sensing line SL #j1 to be electrically connected to the one difference sensing line DSL #1 can be formed as one body with the one difference sensing line DSL #1 on one layer. Thus, a panel design and a panel manufacturing process are not complicated.

If there are two or more difference sensing lines as illustrated in FIG. 13, two or more difference sensing lines DSL #1, DSL #2, . . . may be configured as illustrated in FIG. 15 and disposed in the organic light emitting display panel 110.

FIG. 15 is a schematic diagram enlarging an area B including an overlap point between two difference sensing lines DSL #1 and DSL #2 and an area C including an overlap point between one difference sensing line DSL #2 of the two difference sensing lines DSL #1 and DSL #2 and a second sensing line SL #j1 as illustrated in FIG. 13.

Referring to FIG. 15, in the area B and the area C, two or more second sensing lines SL #j1 and SL #j2 of S number of second sensing lines SL #j1, . . . , SL #jS electrically connected to the second source driver integrated circuit SDIC #j and two or more difference sensing lines DSL #1 and DSL #2 electrically connected to the first source driver integrated circuit SDIC #i may be located on a first layer L3 as being separated from each other.

Referring to FIG. 15, in the area B including the overlap point between the two difference sensing lines DSL #1 and DSL #2, between one DSL #1 of the two or more difference sensing lines DSL #1 and DSL #2 and one SL #j1 of the two or more second sensing lines SL #j1 and SL #j2, another one DSL #2 of the two or more difference sensing lines DSL #1 and DSL #2 is present.

Referring to FIG. 15, in the area B, each of one DSL #1 of the two or more difference sensing lines DSL #1 and DSL #2 and one SL #j1 of the two or more second sensing lines SL #j1 and SL #j2 is connected to a connection line 1500 located on a second layer L1 through a contact hole CNT.

Thus, one DSL #1 of the two or more difference sensing lines DSL #1 and DSL #2 and one SL #j1 of the two or more second sensing lines SL #j1 and SL #j2 may be electrically connected to each other by the connection line 1500 located on the second layer L1.

Referring to FIG. 15, in the area C including the overlap point between the one difference sensing line DSL #2 of the two difference sensing lines DSL #1 and DSL #2 and the second sensing line SL #j1, between one DSL #2 of the two or more difference sensing lines DSL #1 and DSL #2 and one SL #j2 of the two or more second sensing lines SL #j1 and SL #j2, another one SL #j1 of the two or more second sensing lines SL #j1 and SL #j2 is present.

Referring to FIG. 15, in the area C, each of one DSL #2 of the two or more difference sensing lines DSL #1 and DSL #2 and one SL #j2 of the two or more second sensing lines SL #j1 and SL #j2 is connected to the connection line 1500 located on the second layer L1 through the contact hole CNT.

Thus, one DSL #2 of the two or more difference sensing lines DSL #1 and DSL #2 and one SL #j2 of the two or more second sensing lines SL #j1 and SL #j2 may be electrically connected to each other by the connection line 1500 located on the second layer L1.

Referring to FIG. 15, an insulation layer L2 may be present between the first layer L3 and the second layer L1.

For example, the first layer L3 may be a layer on which patterns of a source-drain material are patterned and the second layer L1 may be a layer on which patterns of a gate material are patterned.

If the number of difference sensing lines in the organic light emitting display panel 110 is set to 2 or more in order to more accurately recognize a sensing difference, there may be an overlap between difference sensing lines and there may be an overlap between a difference sensing line and a sensing line.

With the above-described structure, two or more difference sensing lines DSL #1 and DSL #2 can be respectively connected to two or more sensing lines SL #j1 and SL #j2 even if there is an overlap between lines.

Figure 16:
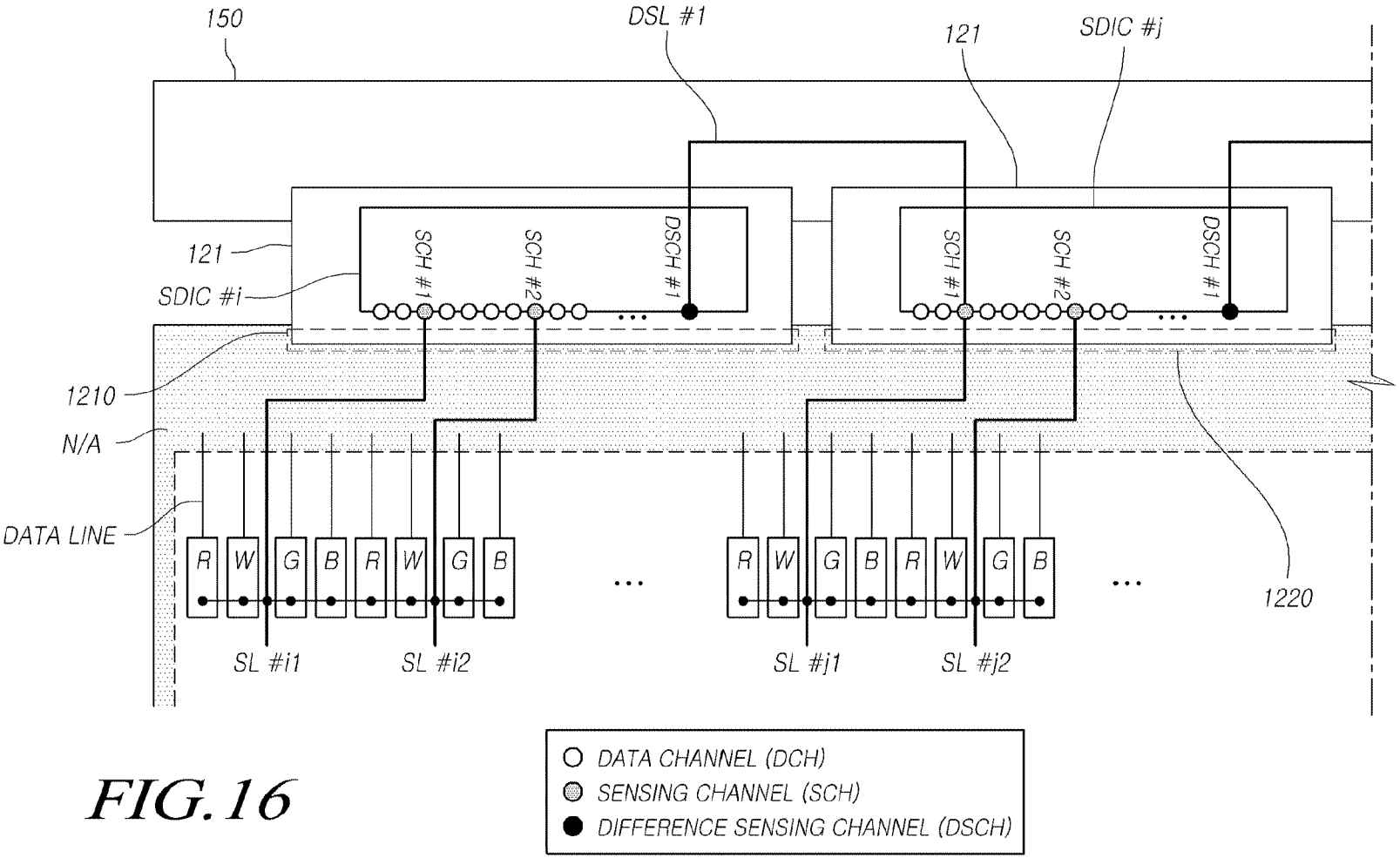
FIG. 16 and FIG. 17 are exemplary diagrams illustrating that at least one difference sensing line for sensing a sensing difference between source driver integrated circuits is provided in a source printed circuit board according to the present exemplary embodiments.
Figure 17:
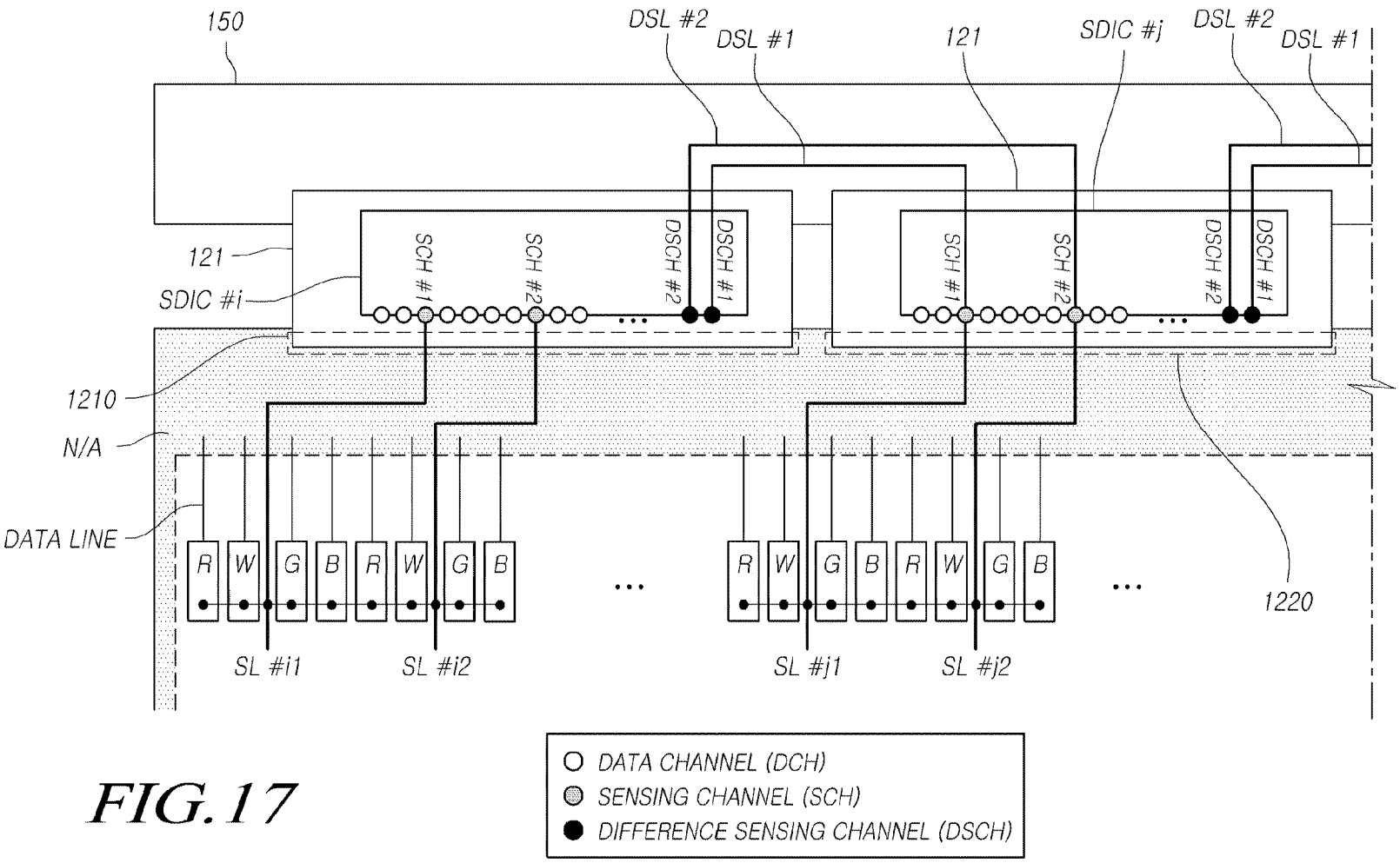

FIG. 16 and FIG. 17 are exemplary diagrams illustrating that at least one difference sensing line DSL #1, . . . for sensing a sensing difference between the two source driver integrated circuits SDCI #i and SDIC #j is provided in the source printed circuit board 150 according to the present exemplary embodiments.

Referring to FIG. 16 and FIG. 17, at least one difference sensing line DSL #1, . . . present between every two source driver integrated circuits SDCI #i and SDIC #j may be located on a printed circuit board (for example, the source printed circuit board 150) electrically connected to the first source driver integrated circuit SDIC #i and the second source driver integrated circuit SDIC #j.

In this case, the at least one difference sensing line DSL #1, . . . present between every two source driver integrated circuits SDCI #i and SDIC #j is bypassed within each of the first source driver integrated circuit SDIC #i and the second source driver integrated circuit SDIC #j and connects at least one difference sensing channel DSCH #1, . . . and at least one second sensing channel SCH #1, . . . to each other.

As described above, if the at least one difference sensing line DSL #1, . . . present between every two source driver integrated circuits SDCI #i and SDIC #j is disposed on the printed circuit board, a structure for recognizing a sensing difference can be formed without affecting the organic light emitting display panel 110.

Figure 18:
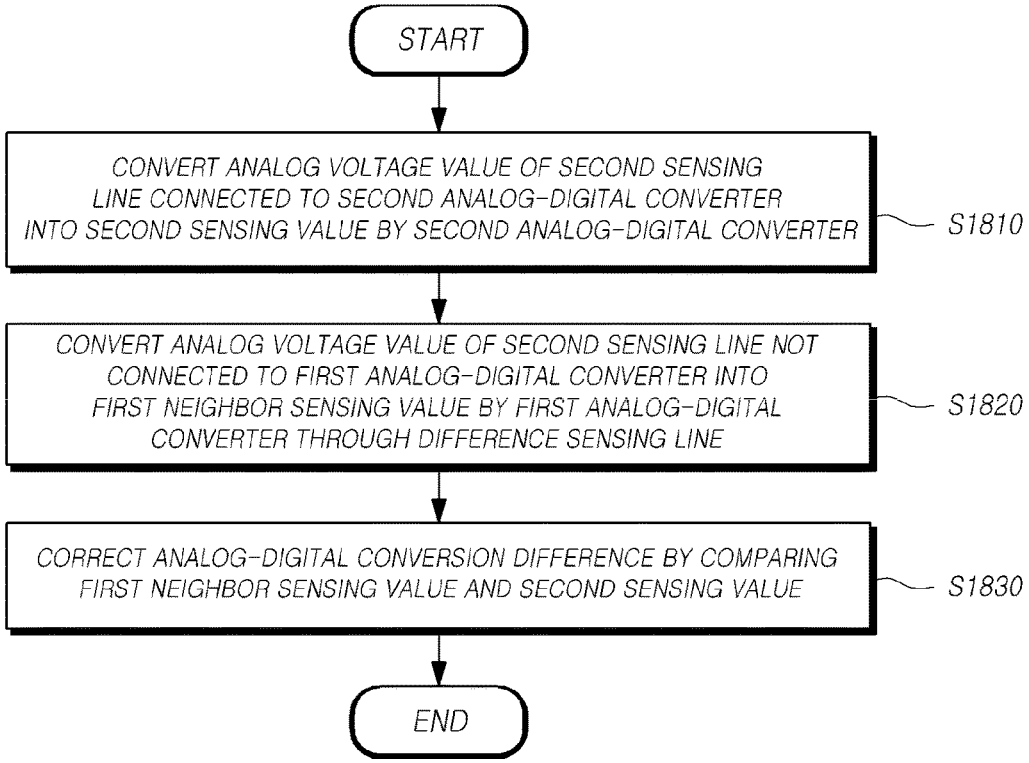
FIG. 18 is a flowchart illustrating a method for driving the organic light emitting display device according to the present exemplary embodiments.
Figure 19:
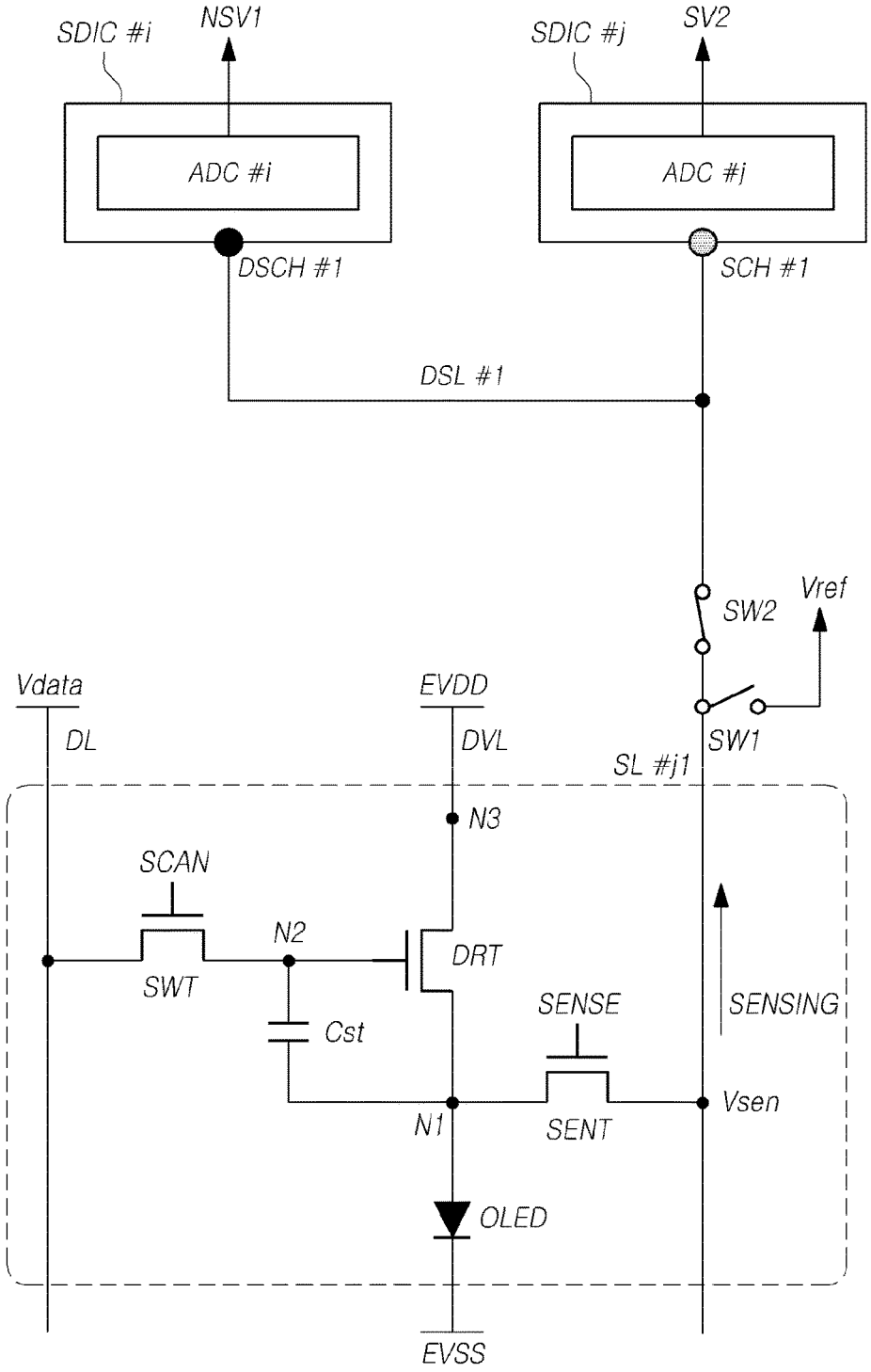
FIG. 19 is an exemplary diagram provided to explain a method for sensing a sensing difference between two source driver integrated circuits by the method for driving the organic light emitting display device according to the present exemplary embodiments.

FIG. 18 is a flowchart illustrating a method for driving the organic light emitting display device 100 according to the present exemplary embodiments, and FIG. 19 is an exemplary diagram provided to explain a method for sensing a sensing difference between the two source driver integrated circuits SDIC #i and SDIC #j by the method for driving the organic light emitting display device 100 according to the present exemplary embodiments.

Referring to FIG. 18 and FIG. 19, a method for driving the organic light emitting display device 100 including a first source driver integrated circuit SDIC #i and a second source driver integrated circuit SDIC #j may include: sensing an analog voltage value Vsen of a second sensing line SL #j1 electrically connected to a second analog-digital converter ADC #j within the second source driver integrated circuit SDIC #j and converting the analog voltage value Vsen into a second sensing value SV2, which is a digital value, by the second analog-digital converter ADC #j (S1810); sensing the analog voltage value Vsen of the second sensing line SL #j1 electrically connected to a difference sensing line DSL #1 electrically connected to a first analog-digital converter ADC #i within the first source driver integrated circuit SDIC #i and converting the analog voltage value Vsen into a first neighbor sensing value NSV1, which is a digital value, by the first analog-digital converter ADC #i through the difference sensing line DSL #1 (S1820); and correcting an analog-digital conversion difference (sensing difference) between the first analog-digital converter ADC #i and the second analog-digital converter ADC #j by comparing the first neighbor sensing value NSV1 and the second sensing value SV2 (S1830).

According to the method for driving the organic light emitting display device 100, the second analog-digital converter ADC #j included in the second source driver integrated circuit SDIC #j and the first analog-digital converter ADC #i included in the first source driver integrated circuit SDIC #i may perform analog-digital conversions to the same voltage of one second sensing line SL #j1 at the same time.

Thus, it is possible to recognize a sensing difference (i.e., analog-digital conversion difference) between the first analog-digital converter ADC #i included in the first source driver integrated circuit SDIC #i and the second analog-digital converter ADC #j included in the second source driver integrated circuit SDIC #j.

Referring to FIG. 19, both the first neighbor sensing value NSV1 and the second sensing value SV2 may include a voltage component among sub-pixel characteristics of a sub-pixel connected to the same second sensing line SL #j1.

Herein, the sub-pixel characteristics may include characteristics (for example, threshold voltage, mobility, and the like.) of the driving transistor DRT within a sub-pixel or characteristics (for example, threshold voltage, and the like.) of the organic light emitting diode OLED within the sub-pixel.

Therefore, it is possible to recognize a sensing difference between the source driver integrated circuits SDIC #i and SDIC #j while sensing the sub-pixel characteristics. More specifically, the second analog-digital converter ADC #j included in the second source driver integrated circuit SDIC #j and the first analog-digital converter ADC #i included in the first source driver integrated circuit SDIC #i can sense sub-pixel characteristics of the same sub-pixel at the same time and thus can more accurately recognize a sensing difference (i.e., analog-digital conversion difference) between the first analog-digital converter ADC #i included in the first source driver integrated circuit SDIC #i and the second analog-digital converter ADC #j included in the second source driver integrated circuit SDIC #j.

Figure 20:
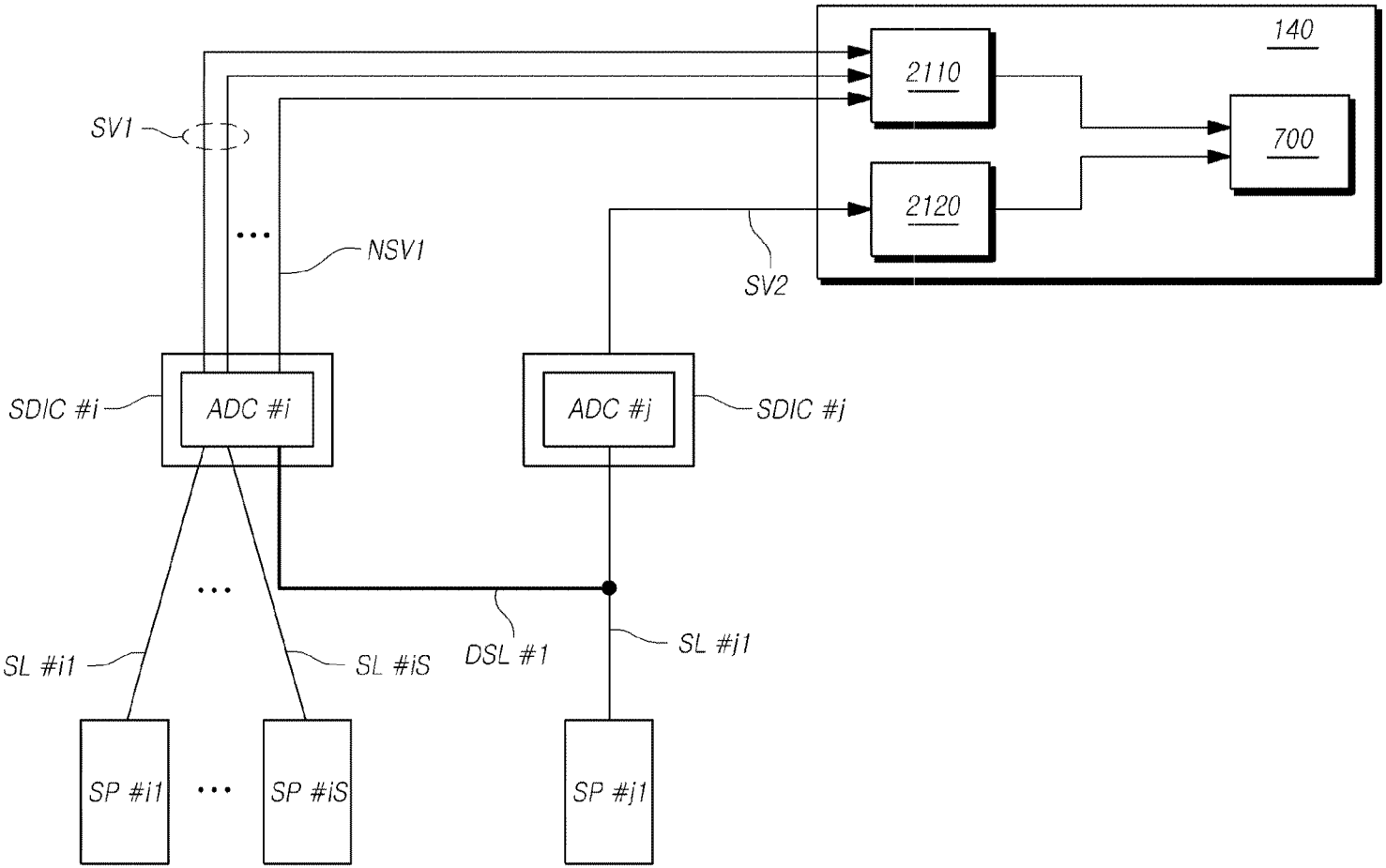
FIG. 20 is a block diagram of a controller according to the present exemplary embodiments.

FIG. 20 is a block diagram of the controller 140 according to the present exemplary embodiments.

Referring to FIG. 20, the controller 140 according to the present exemplary embodiments may include: a first sensing data receiving unit 2110 configured to receive first sensing data including a first neighbor sensing value NSV1 generated by a first analog-digital converter ADC #i; a second sensing data receiving unit 2120 configured to receive second sensing data including a second sensing value SV2 generated by a second analog-digital converter ADC #j; and the analog-digital conversion difference correction unit 700 configured to recognize an analog-digital conversion difference between the first analog-digital converter ADC #i and the second analog-digital converter ADC #j on the basis of the first neighbor sensing value NSV1 and the second sensing value SV2 and correct first sensing value SV1 and second sensing value SV2 to be received on the basis of the recognized analog-digital conversion difference (sensing difference) to correct the analog-digital conversion difference.

The first neighbor sensing value NSV1 and the second sensing value SV2 are sensing values of characteristics of the same sub-pixel SP #j1.

The second sensing value SV2 is a digital value obtained by converting a voltage of a second sensing line SL #j1 by the second analog-digital converter ADC #j.

The first neighbor sensing value NSV1 is a digital value obtained by converting a voltage of the second sensing line SL #j1 by the first analog-digital converter ADC #i through a difference sensing line DSL #1.

Herein, the term "same sub-pixel SP #j1" refers to a sub-pixel which is data-driven by the second source driver integrated circuit SDIC #j including the second analog-digital converter ADC #j.

With the above-described controller 140, it is possible to accurately recognize and correct a sensing difference (i.e., analog-digital conversion difference) between the first analog-digital converter ADC #i included in the first source driver integrated circuit SDIC #i and the second analog-digital converter ADC #j included in the second source driver integrated circuit SDIC #j.

The first sensing data received from the first analog-digital converter ADC #i may further include first sensing values SV1 of sub-pixel characteristics of S-number of sub-pixels SP #i1, . . . , SP #iS which are data-driven by the first source driver integrated circuit SDIC #i including the first analog-digital converter ADC #i.

Herein, the first sensing values SV1 of sub-pixel characteristics of each of S-number of sub-pixels SP #i1, . . . , SP #iS are digital values obtained by converting voltage values of S number of first sensing lines SL #i1, . . . , SL #iS by the first analog-digital converter ADC #i.

Therefore, the first analog-digital converter ADC #i can perform a sensing process for recognizing a sensing difference while performing a sub-pixel characteristic sensing to each of the S number of sub-pixels SP #i1, . . . , SP #iS directly connected to the first analog-digital converter ADC #i at the same time.

According to the present exemplary embodiments described above, it is possible to improve an image quality by reducing or removing a sensing difference between sensing components configured to sense sub-pixel characteristics. Herein, the sensing components may include the sensing unit 210, the analog-digital converters ADC #i and ADC #j, and the source driver integrated circuits SDIC #i and SDIC #j.

According to the present exemplary embodiments, it is possible to more accurately recognize a sensing difference between sensing components configured to sense sub-pixel characteristics. Herein, the sensing components may include the sensing unit 210, the analog-digital converters ADC #i and ADC #j, and the source driver integrated circuits SDIC #i and SDIC #j.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display device, comprising:

a first source driver integrated circuit electrically connected to Q (where Q≥1) number of first sensing lines through a corresponding number of Q sensing channels, and electrically connected to at least one first difference sensing line through a corresponding difference sensing channel; and a second source driver integrated circuit electrically connected to S (where S≥1) number of second sensing lines through a corresponding number of S sensing channels, and electrically connected to at least one second difference sensing line through a corresponding difference sensing channel;

wherein the at least one difference sensing line electrically connected to the first source driver integrated circuit is configured to electrically connect at least one second sensing line of the S number of second sensing lines and the first source driver integrated circuit, wherein the first source driver integrated circuit includes:

a first sample and hold circuit configured to store a voltage of each of the Q number of first sensing lines and the at least one difference sensing line, and a first analog-digital converter electrically connected to the a first sample and hold circuit, and wherein the second source driver integrated circuit includes:

a second sample and hold circuit configured to store a voltage of each of the S number of second sensing lines, and a second analog-digital converter electrically connected to the second sample and hold circuit, and wherein the second sample and hold circuit and the first sample and hold circuit store analog voltage values of the at least one second sensing line and the at least one difference sensing line respectively during a same sensing period.

2. The organic light emitting display device according to claim 1, wherein:

the Q number of first sensing lines are electrically connected to a first sub-pixel, which is supplied with a data voltage from the first source driver integrated circuit;

the S number of second sensing lines are electrically connected to a second sub-pixel, which is supplied with a data voltage from the second source driver integrated circuit; and the at least one difference sensing line electrically connected to the first source driver integrated circuit is not electrically connected to the first sub-pixel, which is supplied with a data voltage from the first source driver integrated circuit, but is electrically connected to the second sub-pixel, which is supplied with a data voltage from the second source driver integrated circuit.

3. The organic light emitting display device according to claim 1, wherein the at least one difference sensing line electrically connected to the first source driver integrated circuit or the second source driver integrated circuit is located in an organic light emitting display panel.

4. The organic light emitting display device according to claim 1, wherein the at least one difference sensing line electrically connected to the first source driver integrated circuit is located in a printed circuit board electrically connected to the first source driver integrated circuit and the second source driver integrated circuit.

5. The organic light emitting display device according to claim 1, further comprising an analog-digital conversion difference correction unit configured to:

receive first sensing data including a first sensing value converted into a digital value from an analog voltage value of each of at least one second sensing line from the first analog-digital converter within the first source driver integrated circuit through the at least one difference sensing line;

receive second sensing data including a second sensing value converted into a digital value from an analog voltage value of the at least one second sensing line from the second analog-digital converter within the second source driver integrated circuit, compare the first sensing data and the second sensing data;

recognize an analog-digital conversion difference between the first analog-digital converter and the second analog-digital converter based on a comparison result; and perform an analog-digital conversion difference correction process.

6. The organic light emitting display device according to claim 5, wherein:

two or more difference sensing lines are configured to electrically connect two or more second sensing lines of the S number of second sensing lines and the first source driver integrated circuit; and the analog-digital conversion difference correction unit is further configured to:

calculate a first average sensing value by averaging two or more first sensing values included in the first sensing data received from the first analog-digital converter;

calculate a second average sensing value by averaging two or more sensing values included in the second sensing data received from the second analog-digital converter;

recognize the analog-digital conversion difference based on a difference between the first average sensing value and the second average sensing value; and perform the analog-digital conversion difference correction process by correcting at least one of sensing data to be received from the first analog-digital converter and sensing data to be received from the second analog-digital converter based on the analog-digital conversion difference.

7. The organic light emitting display device according to claim 1, wherein:

one difference sensing line electrically connected to the first source driver integrated circuit is configured to electrically connect one second sensing line of the S number of second sensing lines and the first source driver integrated circuit; and the one difference sensing line and the one second sensing line are disposed as one body on the same layer.

8. The organic light emitting display device according to claim 1, wherein:

two or more difference sensing lines are configured to electrically connect two or more second sensing lines of the S number of second sensing lines and the first source driver integrated circuit;

two or more second sensing lines of the S number of second sensing lines electrically connected to the second source driver integrated circuit and the two or more difference sensing lines electrically connected to the first source driver integrated circuit are disposed on the same layer as being separated from each other;

between one of the two or more difference sensing lines and one of the two or more second sensing lines, another one of the two or more difference sensing lines or another one of the two or more second sensing lines is present; and the one of the two or more difference sensing lines and the one of the two or more second sensing lines are electrically connected to each other through a connection line disposed on another layer.

9. A plurality of source driver integrated circuit circuits, comprising:

a first source driver integrated circuit including:

an analog-digital converter electrically connected to Q number of first sensing lines through Q (where Q≥1) number of sensing channels and electrically connected to at least one difference sensing line through at least one difference sensing channel; and a sample and hold circuit configured to store a voltage of each of the Q number of first sensing lines and the at least one difference sensing line; and a second source driver integrated circuit electrically connected to S number of sensing lines through S (where S≥1) number of sending channels, and including a sample and hold circuit configured to store a voltage of each of the S number of second sensing lines, wherein the analog-digital converter is configured to sequentially convert the voltage of each of the Q number of first number of sensing lines and the at least one difference sensing line from the sample and hold circuit into sensing values, which are digital values, wherein the at least one difference sensing line is configured to electrically connect at least one second sensing line of the S number of second sensing lines to the first source driver integrated circuit, and wherein the sample and hold circuit of the second source driver integrated circuit and the sample and hold circuit of the first source driver integrated circuit store analog voltage values of at least one of the S number of second sensing lines and the at least one difference sensing line respectively during a same sensing period.

10. An organic light emitting display device, comprising:

a first analog-digital converter electrically connected to Q (where Q≥1) number of first sensing lines;

a second analog-digital converter electrically connected to S (where S≥1) number of second sensing lines; and at least one difference sensing line configured to electrically connect at least one second sensing line of the S number of second sensing lines and the first analog-digital converter, wherein the organic light emitting display device further comprising: a first sample and hold circuit, through which the at least one difference sensing line electrically connects the at least one second sensing line of the S number of second sensing lines and the first analog-digital converter, and configured to store a first voltage of each of the Q number of first sensing lines and the at least one difference sensing line; and a second sample and hold circuit configured to store a second voltage of each of the S number of second sensing lines, wherein the first analog-digital converter sequentially converts the first voltage of each of the Q number of sensing lines and the at least one difference sensing line from the first sample and hold circuit into first sensing values, which are digital values, and the second analog-digital converter sequentially converts the second voltage of each of the S number of sensing lines from the second sample and hold circuit into second sensing values, which are digital values, and wherein the second sample and hold circuit and the first sample and hold circuit store analog voltage values of at least one of the S number of second sensing lines and the at least one difference sensing line respectively during a same sensing period.

11. A method for driving an organic light emitting display device including a first source driver integrated circuit and a second source driver integrated circuit, the method comprising:

sensing an analog voltage value of a second sensing line electrically connected to a second analog-digital converter within the second source driver integrated circuit, storing the analog voltage value by a second sample and hold circuit and converting the stored analog voltage value into a second sensing value, which is a digital value, by the second analog-digital converter;

sensing an analog voltage value of the second sensing line electrically connected to a difference sensing line electrically connected to a first analog-digital converter within the first source driver integrated circuit, storing the analog voltage value of the second sensing line electrically connected to the difference sensing line by a first sample and hold circuit and converting the stored analog voltage value into a first neighbor sensing value, which is a digital value, by the first analog-digital converter through the difference sensing line; and correcting an analog-digital conversion difference between the first analog-digital converter and the second analog-digital converter by comparing the first neighbor sensing value and the second sensing value, wherein the first neighbor sensing value and the second sensing value are based on analog voltage values from the first sample and hold circuit and the second sample and hold circuit during a same sensing period.

12. The method for driving an organic light emitting display device according to claim 11, wherein both the first neighbor sensing value and the second sensing value include a voltage component among sub-pixel characteristics of a sub-pixel connected to the second sensing line.

13. An organic light emitting display device, comprising:

a first sensing data receiving unit configured to receive first sensing data including a first neighbor sensing value generated by a first analog-digital converter electrically connected to at least one second sensing line that is electrically connected to a second sensing data receiving unit through at least one difference sensing line;

the second sensing data receiving unit configured to receive second sensing data including a second sensing value generated by a second analog-digital converter that is electrically connected to the at least one second sensing line; and an analog-digital conversion difference correction unit configured to correct a successive first sensing value and a successive second sensing value based on the first neighbor sensing value and the second sensing value, wherein the first sensing value and the second sensing value are sensing values of characteristics corresponding to a same sub-pixel, and are based on analog voltage values from a first sample and hold circuit, through which the at least one difference sensing line electrically connects the at least one second sensing line and the first analog-digital converter, and a second sample and hold circuit, through which the at least one second sensing line is electrically connected to the second analog-digital converter, during a same sensing period.

14. The controller according to claim 13, wherein the first sensing data further includes first sensing value of characteristics of sub-pixels, which are data-driven by a first source driver integrated circuit including the first analog-digital converter.

* * * * *